US010071464B2

(12) United States Patent
Puzz et al.

(10) Patent No.: US 10,071,464 B2
(45) Date of Patent: Sep. 11, 2018

(54) FLOWABLE COMPOSITE PARTICLE AND AN INFILTRATED ARTICLE AND METHOD FOR MAKING THE SAME

(71) Applicant: Kennametal Inc., Latrobe, PA (US)

(72) Inventors: Travis E. Puzz, Fayetteville, AR (US); Senthilkumar Chandrasekaren, Bentonville, AR (US); Jonathan W. Bitler, Fayetteville, AR (US)

(73) Assignee: KENNAMETAL INC., Latrobe, PA (US)

( * ) Notice: Subject to any disclaimer, the term of this patent is extended or adjusted under 35 U.S.C. 154(b) by 649 days.

(21) Appl. No.: 14/598,516

(22) Filed: Jan. 16, 2015

(65) Prior Publication Data

US 2016/0303710 A1 Oct. 20, 2016

(51) Int. Cl.

| | |
|---|---|
| ***C09K 3/14*** | (2006.01) |
| ***B24D 3/06*** | (2006.01) |
| ***E21B 10/46*** | (2006.01) |
| ***C22C 1/10*** | (2006.01) |
| ***C22C 29/06*** | (2006.01) |
| ***C22C 29/08*** | (2006.01) |
| *B24D 3/00* | (2006.01) |
| *B24D 11/00* | (2006.01) |
| *B24D 18/00* | (2006.01) |

(52) U.S. Cl.

CPC ..... *B24D 3/06* (2013.01); *C22C 1/1036* (2013.01); *C22C 29/067* (2013.01); *C22C 29/08* (2013.01); *E21B 10/46* (2013.01)

(58) Field of Classification Search

USPC ..... 51/309, 293, 307

See application file for complete search history.

(56) References Cited

U.S. PATENT DOCUMENTS

| | | | |
|---|---|---|---|
| 3,379,503 | A | 4/1968 | McKenna |
| 4,834,963 | A | 5/1989 | Terry et al. |
| 5,439,638 | A | 8/1995 | Houck et al. |
| 5,589,268 | A | 12/1996 | Kelley et al. |
| 5,662,183 | A | 9/1997 | Fang |

(Continued)

OTHER PUBLICATIONS

Abdullah et al., "The Use of Bulk Density Measurements as Flowability Indicators",Powder Technoiogy, 102 (1999) pp. 151-165.

(Continued)

*Primary Examiner* — James E McDonough

(74) *Attorney, Agent, or Firm* — Larry R. Meenan

(57) ABSTRACT

A flowable composite particle that includes a plurality of bound hard particles and a binder alloy. The bound hard particles are unfractured bound hard particles and fractured bound hard particles. Each of the bound hard particles is bonded to the binder alloy. The bound hard particles have a particle size of −325 Mesh. The flowable composite particle have a particle size distribution is: (a) between more than about zero weight percent and about 5 weight percent flowable composite particles of a +80 Mesh particle size, (b) between about 60 weight percent and about 95 weight percent flowable composite particles of a −80+325 Mesh particle size, and (c) between more than about zero weight percent and about 35 weight percent flowable composite particles of a −325 Mesh particle size.

13 Claims, 19 Drawing Sheets
(11 of 19 Drawing Sheet(s) Filed in Color)

(56) References Cited

U.S. PATENT DOCUMENTS

| | | | | |
|---|---|---|---|---|
| 5,733,649 | A | 3/1998 | Kelley et al. | |
| 5,733,664 | A * | 3/1998 | Kelley | B22F 1/0014 428/212 |
| 6,287,360 | B1 | 9/2001 | Kembaiyan et al. | |
| 6,682,580 | B2 | 6/2004 | Findeisen et al. | |
| 6,984,454 | B2 | 1/2006 | Majagi | |
| 7,250,069 | B2 | 7/2007 | Kembaiyan et al. | |
| 7,350,599 | B2 | 4/2008 | Lockwood et al. | |
| 7,398,840 | B2 | 7/2008 | Ladi et al. | |
| 7,475,743 | B2 | 1/2009 | Liang et al. | |
| 7,926,597 | B2 | 4/2011 | Majagi et al. | |
| 8,016,057 | B2 | 9/2011 | Deng et al. | |
| 2004/0245024 | A1 | 12/2004 | Kembaiyan | |
| 2007/0240910 | A1 | 10/2007 | Kembaiyan et al. | |
| 2007/0277646 | A1 | 12/2007 | Terry et al. | |
| 2008/0017421 | A1 | 1/2008 | Lockwood | |
| 2008/0206585 | A1 | 8/2008 | Deng et al. | |
| 2008/0289880 | A1 | 11/2008 | Majagi et al. | |

OTHER PUBLICATIONS

ASTM Standard E 11-13 (2014) Standard Specification for Woven Wire Test Sieve Cloth and Test Sieves. ASTM International pp. 1-9.

* cited by examiner

As-polished at 100X mag.

As-polished at 200X mag.

As-polished at 500X mag.

Murakami etchant
(10sec.) at 100X mag.

Murakami etchant
(10sec.) at 200X mag.

Coarse Cast WC
(-80/+325 mesh)

Coarse Macrocrystalline WC
(-80/+325 mesh)

Fine Cast WC
(-325 mesh)
Not flowable

Fine Macrocrystalline WC
(-325 mesh)
Not flowable

FLOWABLE COMPOSITE PARTICLE AND AN INFILTRATED ARTICLE AND METHOD FOR MAKING THE SAME

BACKGROUND

The present invention pertains to a flowable composite particle, as well as an infiltrated article using the flowable composite particles, as well as a method for making the infiltrated article. More specifically, the invention pertains to a flowable composite particle that comprises a plurality of unfractured and fractured hard particles bonded to a binder alloy. The invention further pertains to an infiltrated article that uses a plurality of the flowable composite particles wherein each flowable composite particle comprises a plurality of unfractured and fractured hard particles bonded to a binder alloy, and wherein the flowable composite particles are bonded to an infiltrant alloy.

In order to form the flowable composite particles, an article such as, for example and without limitation, a spent infiltrated matrix bit body of a drill bit (e.g., a subterranean drill bit) is subjected to a comminution or pulverization operation (e.g., a progressive stepped comminution or pulverization operation). Unused articles such as coupons with a specific composition can also be subjected to a comminution or pulverization operation (e.g., a progressive stepped comminution or pulverization operation) to form the flowable composite particles. The article, whether it is a spent infiltrated matrix bit bodies of a drill bit or an unused coupon, comprises hard particles (e.g., unfractured hard particles) bonded to a binder alloy. The comminution or pulverization operation (e.g., a progressive stepped comminution or pulverization operation) of the article breaks the article into suitable flowable composite particles. The present invention in the form of the flowable composite particles comprises particulates of a fine size (e.g., a particle size distribution comprising: (a) between more than about zero weight percent and about 5 weight percent flowable composite particles of a +80 Mesh particle size, (b) between about 60 weight percent and about 95 weight percent flowable composite particles of a −80+325 Mesh particle size, and (c) between more than about zero weight percent and about 35 weight percent flowable composite particles of a −325 Mesh particle size) wherein the flowable composite particle itself comprise hard particles of macrocrystalline tungsten carbide (WC) grains (−400 Mesh), cast tungsten carbide ($WC/W_2C$) grains (−400 Mesh), and cemented (binder such as, for example, cobalt and/or nickel and their alloys and like metals) tungsten carbide. The present invention in the form of the infiltrated article (e.g., infiltrated matrix bit body material) comprises a mass of the flowable composite particles (i.e., a particulate mass) that have been infiltrated with an infiltrant alloy to form the infiltrated article that exhibits beneficial properties such as, for example, an advantageous balance between higher erosion resistance and higher transverse rupture strength.

While some of the discussion herein pertains to drill bits, there is the contemplation that many others kinds of other articles can be made from the flowable composite particles. For example, the flowable composite particles can be used as the filler material for a copper composite hardfacing rod. The flowable composite particles can also be used as the filler material for an iron-based hardfacing rod. The flowable composite particles can be mixed with wax wherein the mixture is pressed into a shape and sintered into a sintered article. There should be an understanding that the above infiltrated articles are merely exemplary, and that the flowable composite particles are suitable for use in a wide variety of articles in which the article is formed by the infiltration of a mass of particles by an infiltrant alloy.

In reference to drill bits, it is well-known to use in subterranean applications such as mining and drilling, drill bits for gas and oil drilling having bit bodies or portions thereof which comprise an infiltrated metal matrix. Such bit bodies typically comprise one or more cutting elements, such as polycrystalline diamond cutting inserts, embedded in, brazed to or otherwise carried by the infiltrated metal matrix. The bit bodies are typically formed by positioning the cutting elements within a graphite mold, filling the mold with a matrix powder mixture, and then infiltrating the matrix powder mixture with an infiltrant metal. The following United States patents and published United States patent applications pertain to or disclose an infiltrated matrix powder useful for forming subterranean drill bit bodies: U.S. Pat. No. 6,984,454 B2 to Majagi, U.S. Pat. No. 5,589,268 to Kelley et al., U.S. Pat. No. 5,733,649 to Kelley et al., U.S. Pat. No. 5,733,664 to Kelley et al., U.S. Patent Application Publication No. 2008/0289880 A1 to Majagi et al., U.S. Patent Application Publication No. 2007/0277646 A1 to Terry et al., U.S. Pat. No. 8,016,057 to Deng et al., all of which are assigned to the assignee of the present patent application. The following United States patents and published United States patent applications also pertain to or disclose an infiltrant matrix powder for bit bodies: U.S. Pat. No. 7,475,743 B2 to Liang et al., U.S. Pat. No. 7,398,840 B2 to Ladi et al., U.S. Pat. No. 7,350,599 B2 to Lockwood et al., U.S. Pat. No. 7,250,069 B2 to Kembaiyan et al., U.S. Pat. No. 6,682,580 to Findeisen et al., U.S. Pat. No. 6,287,360 B1 to Kembaiyan et al., U.S. Pat. No. 5,662,183 to Fang, U.S. Patent Application Publication No. 2008/0017421 A1 to Lockwood, U.S. Patent Application Publication No. 2007/0240910 A1 to Kembaiyan et al., and U.S. Patent Application Publication No. 2004/0245024 A1 to Kembaiyan.

Referring to U.S. Patent Application Publication No. 2007/0240910 A1, this document discloses a composition for forming a matrix body which includes spherical cemented tungsten carbide and an infiltration binder including one or more metals or alloys. The composition may also include cast tungsten carbide and/or carburized tungsten carbide. The amount of sintered spherical tungsten carbide in the composition preferably is in the range of about 30 to about 90 weight percent. Spherical or crushed cast carbide, when used, may comprise 15 to 50 weight percent of the composition and the carburized tungsten carbide, when used, may comprise about 5 to 30 weight percent of the composition. The composition may also include about 1 to 12 weight percent of one or more metal powders selected from the group consisting of nickel, iron, cobalt, and other Group VIIIB metals and alloys thereof.

U.S. Pat. No. 7,475,743 B2 discloses a subterranean drill bit that includes a bit body formed from an infiltrated metal matrix powder wherein the matrix powder mixture includes stoichiometric tungsten carbide particles, cemented tungsten carbide particles, cast tungsten carbide particles, and a metal powder. The stoichiometric tungsten carbide particles may have a particle size of −325 (45 micron) +625 mesh (20 micron) and comprise up to 30 weight percent of the matrix powder. The stoichiometric tungsten carbide particles are macrocrystalline tungsten carbide which is, for the most part, in the form of single crystals. The cemented tungsten carbide particles may have a particle size of −170 (90 micron) +625 mesh (20 micron) and account for up to 40 weight percent of the matrix powder. The cast tungsten carbide may have a particle size of −60 (250 micron) +325 mesh (45 micron) and account for up to 60 weight percent of the matrix powder. The metal powder may account for between 1 and 15 weight percent of the matrix powder and may include one or more of nickel, iron, cobalt, and other Group VIIIB metals and alloys thereof.

U.S. Pat. No. 6,682,580 B2 discloses matrix powder mixtures which may be used for producing bodies or components for wear-resistant applications such as drill bits. The matrix powder mixtures contain spheroidal hard material particles having a particle size of less than 500 microns, and preferably in the range of between 20 to 250 microns. The spheroidal hard material particles comprise between about 5 and 100 weight percent of the matrix powder. The matrix powder may also include block hard materials in the size range of between 3 and 250 microns and in the form of crushed carbides or metal powder. These block hard materials function as spacers between the spherical hard material particles to aid in the infiltration of the matrix powder. The spherical hard particles may be spheroidal carbides and are preferably spheroidal cast tungsten carbide. They also may be dense sintered cemented tungsten powders with a closed porosity or pore-free sintered cemented tungsten carbide pellets. The spheroidal carbides also may be carbides of the metals in the group consisting of tungsten, chromium, molybdenum, vanadium, and titanium. The metal powder may comprise between about 1 to 12 weight percent of the matrix powder and be selected from the group consisting of cobalt, nickel, chromium, tungsten, copper, and alloys and mixtures thereof.

U.S. Pat. No. 5,733,664 also discloses matrix powder mixtures (e.g., powder blends) suitable to be infiltrated to form wear element bodies or components for wear-resistant applications such as drill bits. The matrix powder mixtures include crushed sintered cemented tungsten carbide particles, wherein a binder metal comprises between about 5 and 20 weight percent of the cemented tungsten carbide composition. The crushed sintered cemented tungsten carbide powder may account for 50 to 100 weight percent of the matrix powder and have a particle size of −80 (180 micron) +400 mesh (38 micron). The matrix powder mixture may also include up to 24 weight percent of cast tungsten carbide having a particle size of −270 mesh (53 micron) with superfines removed; up to 50 weight percent tungsten carbide particles having a particle size of −80 (180 micron) +325 mesh (45 micron); and between about 0.5 and 1.5 weight percent of iron having an average particle size of 3-5 microns.

Although these earlier infiltrated metal matrices have performed in a satisfactory fashion, there is still an unfilled need for improvements in infiltrated mass of particles including, without limitation, matrix bit bodies such as, for example, subterranean drill bit bodies, for particular applications which require infiltrated metal matrices having beneficial properties (e.g., a combination of good erosion resistance, reasonable strength, and good thermal stability). There have been challenges connected with the flowability of the particles that comprise a component of the infiltrated mass of particles. In the context of a tungsten/copper composite powder, U.S. Pat. No. 5,439,638 to Houck et al. mentions flowability as a goal to achieve. Further, the article by Abdullah et al., entitled "The use of bulk density measurements as flowability indicators", *Powder Technology,* 102 (1999), pp. 151-165 studies particle flow and that flowability can be dependent on particle size. The present invention addresses those unfilled needs by providing a flowable composite particle, as well as an infiltrated mass of the flowable composite particles. Still further, the invention addresses those unfilled needs by providing a flowable composite particle, (which comprises fractured and unfractured hard particle bonded to a binder alloy) as well as an infiltrated mass of the flowable composite particles bonded to an infiltrant alloy.

SUMMARY OF THE INVENTION

In one form thereof, the invention is an infiltrated article that comprises a particulate mass comprising flowable composite particles wherein prior to infiltration with an infiltrant alloy, each of the flowable composite particles comprising a plurality of bound hard particles and a binder alloy. The bound hard particles comprising unfractured bound hard particles and fractured bound hard particles. Each of the bound hard particles is bonded to the binder alloy The bound hard particles have a particle size of −325 Mesh, and the flowable composite particle has a particle size distribution comprising: (a) between more than about zero weight percent and about 5 weight percent flowable composite particles of a +80 Mesh particle size, (b) between about 60 weight percent and about 95 weight percent flowable composite particles of a −80+325 Mesh particle size, and (c) between more than about zero weight percent and about 35 weight percent flowable composite particles of a −325 Mesh particle size. The particulate mass further comprising a plurality of fractured unbound hard particles having a particle size of −400 Mesh wherein a portion of the fractured unbound hard particles having a particle size of −625 Mesh. Each of the fractured unbound hard particles and the flowable composite particles is surrounded by the infiltrant alloy wherein the binder alloy is melted by the infiltrant alloy.

In another form thereof, the invention is a flowable composite particle comprising a plurality of bound hard particles and a binder alloy. The bound hard particles comprises unfractured bound hard particles and fractured bound hard particles. Each of the bound hard particles is bonded to the binder alloy. The bound hard particles have a particle size of −325 Mesh, and the flowable composite particles have a particle size distribution of (a) between more than about zero weight percent and about 5 weight percent flowable composite particles of a +80 Mesh particle size, (b) between about 60 weight percent and about 95 weight percent flowable composite particles of a −80+325 Mesh particle size, and (c) between more than about zero weight percent and about 35 weight percent flowable composite particles of a −325 Mesh particle size.

In still another form, the invention is a method of making an infiltrated article comprising the steps of: providing a particulate mass comprising flowable composite particles wherein each of the flowable composite particles comprising a plurality of bound hard particles and a binder alloy, and the bound hard particles comprising unfractured bound hard particles and fractured bound hard particles, each of the bound hard particles is bonded to the binder alloy, and the bound hard particles having a particle size of −325 Mesh, and the flowable composite particle having a particle size distribution comprising: (a) between more than about zero weight percent and about 5 weight percent flowable composite particles of a +80 Mesh particle size, (b) between about 60 weight percent and about 95 weight percent flowable composite particles of a −80+325 Mesh particle size, and (c) between more than about zero weight percent and about 35 weight percent flowable composite particles of a −325 Mesh particle size; the particulate mass further comprising a plurality of fractured unbound hard particles having a particle size of −400 Mesh wherein a portion of the fractured unbound hard particles having a particle size of −625 Mesh; and infiltrating the particulate mass with an infiltrant alloy wherein the infiltrant alloy melts the binder alloy and each of the fractured unbound hard particles and the flowable composite particles is surrounded by the infiltrant alloy.

BRIEF DESCRIPTION OF THE DRAWINGS

The patent or application file contains at least one drawing executed in color. Copies of this patent or application publication with color drawing(s) will be provided by the Office upon request and payment of the necessary fee.

Below is a brief description of the drawings that form a part of this patent application. The features and merits of the present invention will be better understood by reference to the attached drawings. It is to be understood, however, that the drawings are designed for the purpose of illustration only and not as definitions of the limits of the present invention

DETAILED DESCRIPTION

In this section, some preferred embodiments of the present invention are described in detail sufficient for one skilled in the art to practice the present invention. It is to be understood, however, that the fact that a certain number of preferred embodiments are described herein does not in any way limit the scope of the present invention as set forth in the appended claims.

The particles that form the matrix powder that comprise a component of the end product such as, for example, a subterranean drill bit body, exhibit a particle size. Mesh size is a convenient means for describing the particle sizes of a powder and is used herein for that purpose with regard to the description of the particle of the powder. Mesh sizes are also sometimes called "sieve sizes" or "screen sizes." The numerical portion of the mesh size refers to the number of square openings there are per lineal inch (2.54 cm) of the mesh taken in a direction parallel to the sides of the square openings. For example, 100 mesh refers to a mesh having 100 openings per lineal inch (2.54 cm). Since the length of a side of an opening in the mesh depends on the thickness of the filaments that make up the mesh, various standards have been adopted to govern the filament thickness, and, thereby, side length of the openings. Mesh sizes based upon ASTM Standard E 11-13 (2014) Standard Specification for Woven Wire Test Sieve Cloth and Test Sieves, which is incorporated herein its entirety by reference, i.e., U.S. mesh sizes, are used herein.

In reference to the mesh sizes, for example, powder passing through a 100 mesh size mesh is said to be 100 mesh powder. This may also be expressed by placing a minus sign (−) before the mesh size number. For example, a −100 mesh powder will pass through a 100 mesh screen. A plus (+) sign placed before the mesh size number is used to indicate that the powder is too coarse to pass through a screen mesh of that mesh size. For example, a +100 mesh powder does not pass through a 100 mesh screen. Sometimes two mesh sizes given side by side are used to better describe the particle size of a powder. Under this convention, a minus sign (−) is placed before the first mesh size number (and the word "mesh" beside this number is omitted) to indicate that the powder is small enough to pass through a screen mesh having that mesh size, and a positive sign (+) is placed before the second mesh size to indicate that the powder is too coarse to pass through a screen mesh having that mesh size. Thus, a powder sample described as −100+325 mesh is fine enough to pass through a 100 mesh screen and too coarse to pass through a 325 mesh screen.

Figure 1:
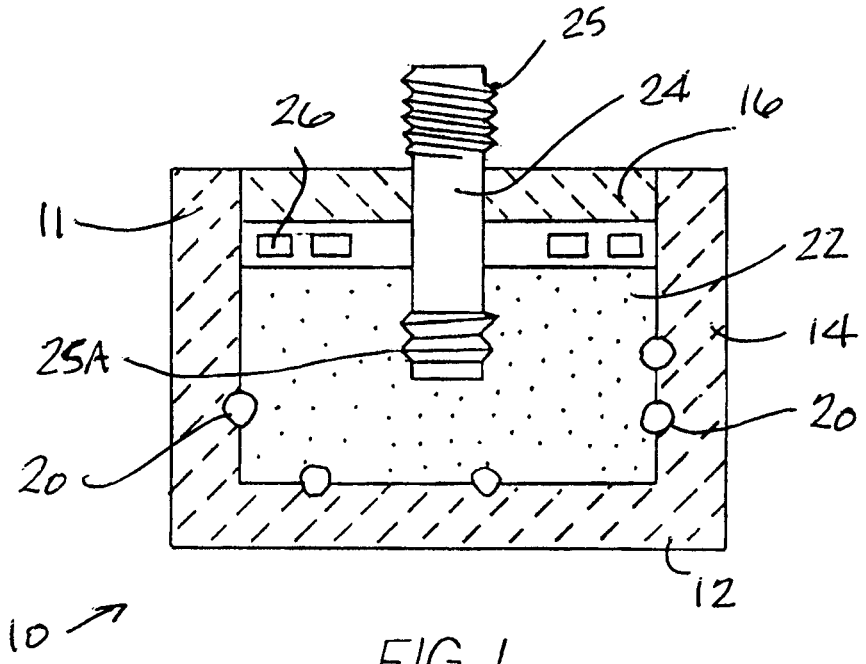
FIG. 1 is a schematic view of an assembly used to make a subterranean drill bit according to an embodiment of the present invention.

Referring to FIG. 1, there is illustrated a schematic of an assembly 10 used to manufacture a subterranean drill bit in accordance with an embodiment of the present invention. The drill bit has a shank 24. Cutter elements, such as discrete cutting elements 20, are bonded to the resultant drill bit by way of the metal matrix of the drill bit body. Although the method by which a drill bit shank is affixed to a drill line may vary, one common method is to provide threads on the shank so that the shank threadedly engages a threaded bore in the drill line. Another way is to weld the shank to the drill line. The assembly 10 includes a graphite mold 11 having a bottom wall 12 and an upstanding wall 14. The mold 11 defines a volume therein. The assembly 10 further includes a top member 16 to close the opening of the mold 11. The use of the top member 16 is optional depending upon the degree of atmospheric control one desires to have over the contents of the mold 11 during thermal processing.

The steel shank 24 is positioned within the mold 11 before the flowable composite particle mixture 22 is poured therein. A portion of the steel shank 24 is within the flowable composite particle mixture 22 and another portion of the steel shank 24 is outside of the flowable composite particle mixture 22. The shank 24 has threads 25 at one end thereof, and grooves 25A at the other end thereof.

The flowable composite particles can be the result of the communition of previously used drill bit bodies and/or unused coupons. The used drill bit bodies and the unused coupons typically comprise a plurality of hard components bonded in a binder alloy. The hard components can comprise cast tungsten carbide (WC) particles, cemented (cobalt) tungsten carbide (WC—Co) particles, and macrocrystalline tungsten carbide particles. The flowable composite particles each typically comprise a binder alloy that contains and bonds the following hard components: unfractured cast tungsten carbide (WC) particles, unfractured cemented (cobalt) tungsten carbide (WC—Co) particles, unfractured macrocrystalline tungsten carbide particles, fractured cast tungsten carbide (WC) particles, fractured cemented (cobalt) tungsten carbide (WC—Co) particles, and fractured macrocrystalline tungsten carbide particles. While some of the particles are WC—Co particles, there should be an appreciation that that the binder alloy of these WC hard particles can be cobalt and/or nickel and their alloys, as well as like metals. This understanding as to the binder alloy for the WC particles is applicable throughout this patent application, where appropriate.

A plurality of discrete cutting elements 20 are positioned to extend into the bottom and upright mold walls 12, 14 so as to be at selected positions on the surface of the resultant drill bit. The flowable composite particle mixture 22 is poured into the mold 11 so as to surround the portions of the cutting elements 20 which extend into the cavity of the mold 11. It is to be understood that in addition to or instead of setting the cutting elements 20 into the walls of the mold 11, cutting elements 20 may be mixed in with the flowable composite particle mixture 22 in amounts up to about 20 volume percent. Details about the nature of the flowable composite particle mixture 22 are discussed later herein.

After the cutting elements 20 have been set and the flowable composite particle mixture 22 has been poured into the mold 11, a solid infiltrant 26 is positioned above the flowable composite particle mixture 22. The top member 16 is then, optionally, positioned to close the opening of the mold 11. The assembly 10 is then placed into a furnace and heated to an elevated temperature so that the infiltrant 26 melts and infiltrates throughout the flowable composite particle mixture 22. Sometimes a flux is added to the binder alloy to facilitate melting. The furnace atmosphere is selected to be compatible with the components of the assembly 10 and typically comprises one or more of nitrogen, hydrogen, argon, and air. The assembly 10 is then cooled to solidify the infiltrant 26. The solidified infiltrant 26 bonds together the flowable composite particle mixture 22, the cutting elements 20, and the steel shank 24 to form a subterranean drill bit.

Figure 2:
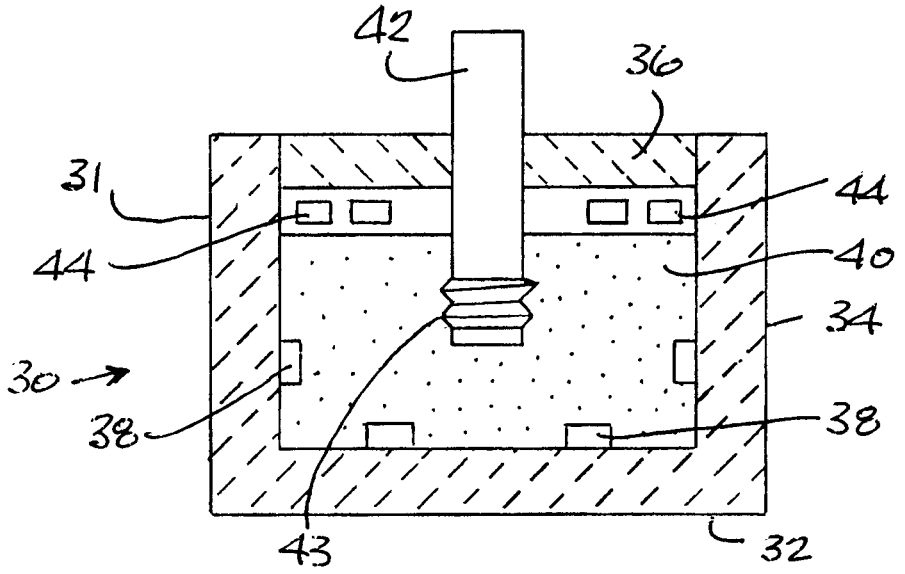
FIG. 2 is a schematic view of an assembly used to make a subterranean drill bit according to another embodiment of the present invention.

Referring to FIG. 2, there is illustrated a schematic of an assembly 30 used to manufacture a subterranean drill bit in accordance with another embodiment of the present invention. The assembly 30 includes a graphite mold 31 having a bottom wall 32 and an upstanding wall 34. The mold 31 defines a volume therein. The assembly 31 further includes a top member 36 to close off the opening of the mold 31. The use of the top member 36 is optional depending upon the degree of atmospheric control one desires to have over the contents of the mold 31 during thermal processing. A steel shank 42 is positioned within the mold 31 before a flowable composite particle mixture 40 is poured therein. A portion of the steel shank 42 is within the flowable composite particle mixture 40 and another portion of the steel shank 42 is outside of the flowable composite particle mixture 40. The shank 42 has grooves 43 at the end that is within the flowable composite particle mixture 40. A plurality of graphite blanks 38 are positioned along the bottom and upright mold walls 32, 34 so as to be at selected positions on the surface of the resultant drill bit. The flowable composite particle mixture 40 is poured into the mold 31 so as to surround the portions of the graphite blanks 38 which extend into the cavity of the mold 31. Details about the nature of the flowable composite particle mixture 40 are discussed later herein.

After the graphite blanks 38 have been set and the flowable composite particle mixture 40 has been poured into the mold 31, a solid infiltrant 44 is positioned above the flowable composite particle mixture 40. The top member 36 is then, optionally, positioned to close the opening of the mold 31. The assembly 30 is then placed into a furnace and heated to an elevated temperature so that the infiltrant 44 melts and infiltrates throughout the flowable composite particle mixture 40. Sometimes a flux is added to the binder alloy to facilitate melting. The furnace atmosphere is selected to be compatible with the components of the assembly 30 and typically comprises one or more of nitrogen, hydrogen, argon, and air. The assembly 30 is then cooled to solidify the infiltrant 44. The solidified infiltrant 44 bonds together the flowable composite particle mixture 40, the graphite blanks 38, and the steel shank 42. The graphite blanks 38 are removed from the bonded mass. Cutting elements, such as diamond composite inserts, are brazed into the recesses left by the removal of the graphite blanks 38 to form a subterranean drill bit.

Figure 3:
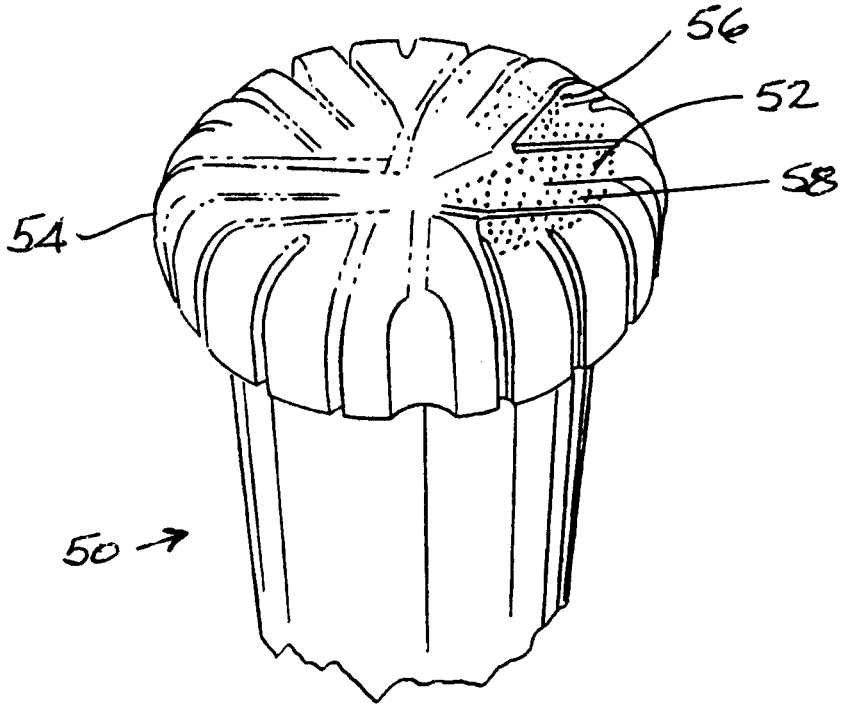
FIG. 3 is an isometric view of a subterranean drill bit according to an embodiment of the present invention.

Referring to FIG. 3, there is shown a subterranean drill bit 50 according to an embodiment of the present invention. The drill bit 50 may be made from a process similar to that described above with regard to FIG. 1. The forward facing surface 52 of the bit body 54 of the drill bit 50 contains cutting elements 56 extending from the infiltrated metal matrix 58 which resulted from the freezing of an infiltrant throughout a flowable composite particle mixture.

Figure 4:
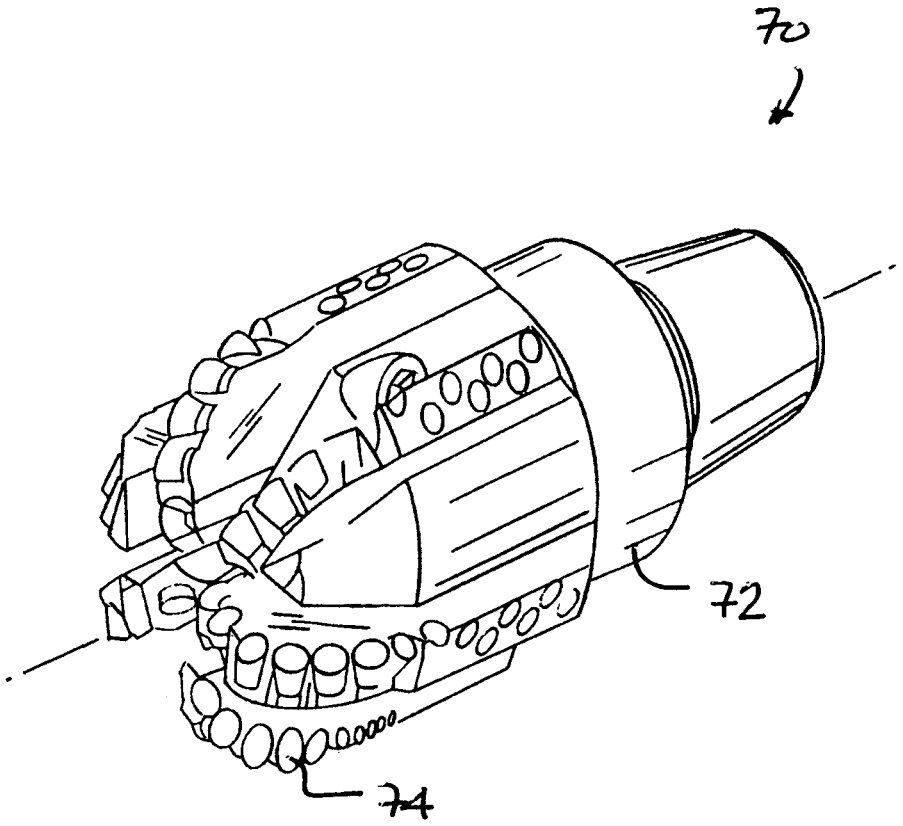
FIG. 4 is an isometric view of a subterranean drill bit according to another embodiment of the present invention.

Referring to FIG. 4, there is shown a subterranean drill bit 70 according to another embodiment of the present invention. The drill bit 70 has a bit body 72 and cutting elements 74. The bit body 72 comprises an infiltrated metal matrix. The cutting elements 74 are brazed to the bit body 72. It is to be understood that the present invention is not limited to subterranean drill bits, but can include a variety of drill bit bodies and other articles that comprises an infiltrated flowable composite particle mixture. The subterranean drill bits according to the present disclosure are not limited to the geometric designs described in the foregoing embodiments. Rather, they include all subterranean drill bits having at least one cutting element carried by a bit body in which the bit body comprises an infiltrated metal matrix comprising an infiltrant and a flowable composite particle mixture. Further, the present invention is not limited to an infiltrated article that is a drill bit, but the infiltrated article can comprise any one of a number of different articles wherein the article is suitable to be an infiltrated mass of flowable composite particles.

Each subterranean drill bit according to the present invention has one or more cutting elements. The cutting elements are preferably natural diamond, polycrystalline diamond sintered to cemented carbide, thermally stable polycrystalline diamond, or a hot pressed metal matrix composite, but can be any suitable hard material known in the art. The size and configuration of each of the cutting elements is selected to be appropriate for the purpose and the conditions under which it is to be used. The manner in which the bit body carries an individual cutting element depends on the design of the particular drill bit and the design of the particular cutting element. For example, cutting elements may be carried directly by the bit body, e.g., by imbedding the cutting elements in the infiltrated metal matrix of the bit body or brazing them to the bit body. Alternatively, the cutting elements may be carried indirectly by the bit body, e.g., by affixing the cutting elements to blades which themselves are affixed to the bit body. For example, U.S. Pat. No. 7,926,597 to Majagi et al., which is assigned to the assignee of the present patent application, describes a bit body carrying cutting elements which are affixed to blades, which are, in turn, affixed to the bit body. Any technique or method known in the art may be used for affixing individual cutting elements and/or blades having cutting elements to the drill bit body, including brazing techniques, infiltration techniques, press fitting techniques, shrink fitting techniques, and welding techniques.

The infiltrated articles of the present invention comprise (i) an infiltrant alloy, and (ii) flowable composite particles, which are a particulate mass that has been infiltrated by an infiltrant alloy. As will be become apparent, the present invention provides an infiltrated article (an infiltrated matrix bit body material) that exhibits a combination of favorable erosion resistance and favorable transverse rupture strength. By using flowable composite particles or at least using flowable composite particles as a portion of the particulate mass, the infiltrated article exhibits favorable and improved properties and especially the combination of erosion resistance and transverse rupture strength. Applicants believe that favorable and improved properties and especially the combination of erosion resistance and transverse rupture strength are due to the fact that the flowable composite particles exhibit excellent flowability so as to fill the volume of a mold prior to infiltration. Further, applicants believe that favorable and improved properties and especially the combination of erosion resistance and transverse rupture strength are achieved because a binder alloy is positioned in the volume of the mold prior to the melting and infiltration process. This is because the flowable composite particles in the mold comprise the hard particles bonded to the binder alloy so that the binder alloy is in position in the mold prior to the melting and infiltration of the infiltrant alloy into the particulate mass. Still further, applicants believes that favorable and improved properties, especially the combination of erosion resistance and transverse rupture strength, are due to the use of the smaller hard particles. These smaller hard particles can be of the size of −400 Mesh and −625 Mesh.

In reference to the infiltrants, all infiltrants known in the art of making infiltrated metal matrix powder subterranean drill bits and similar wear resistant elements may be used in embodiments of the present invention. Other infiltrants may be suitable depending upon the specific application for the infiltrated article.

Examples of infiltrants include metals and alloys comprising one or more transition metal element and main group element. Copper, nickel, iron, and cobalt may be used as the major constituent of the infiltrant and elements such as aluminum, manganese, chromium, zinc, tin, silicon, silver and boron may be minor constituents. Preferred infiltrants are copper-based alloys containing nickel and manganese, and optionally tin and/or boron. Particularly preferred infiltrants of this type are those which are disclosed in U.S. Patent Application Publication No. 2008/0206585 A1 of Deng et al., which is incorporated in its entirety by reference herein. One preferred infiltrant alloy comprises between about 45 weight percent and about 60 weight percent copper, between about 20 weight percent and about 30 weight percent manganese and between about 10 weight percent and about 20 weight percent nickel and between about 4 weight percent and about 12 weight percent zinc. Another particularly preferred infiltrant is the alloy that is available under the trade name MACROFIL 53 from the assignee of this application, Kennametal Inc. of Latrobe, Pa. 15650 United States of America. The MACROFIL 53 infiltrant has a nominal composition (in weight percent) of 53.0 weight percent copper, 24.0 weight percent manganese, 15.0 weight percent nickel, and 8.0 weight percent zinc. Another particularly preferred infiltrant is available under the trade name MACROFIL 65 from the assignee of this application Kennametal Inc. of Latrobe, Pa. 15650 United States of America. The MACROFIL 65 has a nominal composition (in weight percent) of 65 weight percent copper, 15 weight percent nickel, and 20 weight percent zinc. Another preferred infiltrant has a nominal composition (in weight percent) of less than 0.2 weight percent silicon, less than 0.2 weight percent boron, up to 35 weight percent nickel, 5-35 weight percent manganese, up to 15 weight percent zinc, and the balance copper. Still another preferred infiltrant alloy comprises between about 45 weight percent and about 55 weight percent copper and between about 20 weight percent and about 30 weight percent manganese and between about 20 weight percent and about 30 weight percent nickel. More specifically, this preferred infiltrant alloy comprises about 50 weight percent copper, about 25 weight percent manganese and about 25 weight percent nickel.

For any particular embodiment of the present invention, the type and amount of the infiltrant is selected so that it is compatible with the other components of the infiltrated article with which it is to be in operational contact. It is also selected so as to provide the article with the desired levels of strength, toughness, and durability. The amount of infiltrant is selected so that there is sufficient infiltrant to completely infiltrate the flowable composite particles. Typically, the infiltrant makes up between about 20 and 60 volume percent of the infiltrated article wherein the flowable composite particles comprise between about 40 volume percent and 80 volume percent of the infiltrated article.

Figure 5:
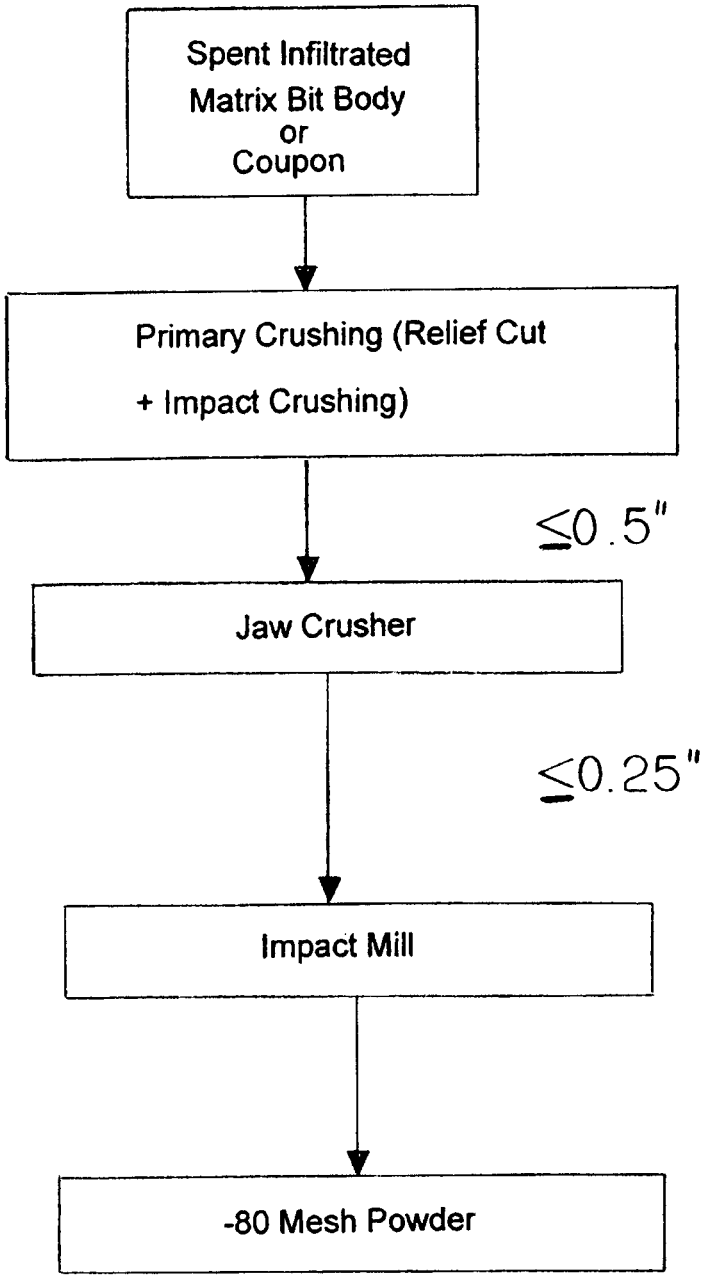
FIG. 5 is a flow chart of the process steps in one specific embodiment of the method for making the flowable composite particles.

In reference to the process to produce the flowable composite particles, FIG. 5 illustrates basic steps for the progressive comminution (or progressive pulverization) of the scrap bit body material or the unused coupons. While the process shown in FIG. 5 comprises specific steps, there is the contemplation that the comminution or pulverization process may comprise a different numbers of steps, especially a lesser number of steps if the initial articles are of a smaller size such as in the case of using unused coupons.

By this progressive comminution, particles are progressively reduced in size through a series of steps. Each such step comminutes the particles to reduce them to a smaller particle size. In this regard, the used or spent bit bodies for drill bits (such as, for example, subterranean drill bits) or unused coupons, undergo a primary crushing operation (or step) by which the used or spent bit bodies are reduced to particulates of a coarser particle size which is, for example, equal to less than about 0.5 inches (about 1.27 centimeters). Next, the coarser-sized particles undergo comminution in a jaw crusher to reduce the coarser-sized particles to be intermediate-sized particles that have a particle equal to less than about 0.25 inches (about 0.64 centimeters). Next, the intermediate-sized particles undergo still further comminution in an impact mill to result in finer-sized particles that have a particle size of −80 Mesh. Although not illustrated in FIG. 5, the finer-sized particle may undergo additional comminution so as to be reduced in size to where they have a particle size equal to −325 Mesh. The goal of this communition operation is not to reduce the particle size of the flowable composite particles to below −325 Mesh. While the above process comprise a multi-step process by which the used or spent bit bodies (or unused coupons) undergo progressive comminution in a step-by-step reduction in particle size, there is the contemplation that other comminution processes comprising other steps or even a single step would be suitable to produce the flowable composite particles.

The particle size distribution of the crushed flowable composite particles is: (a) between more than about zero weight percent and about 5 weight percent flowable composite particles of a +80 Mesh particle size, (b) between about 60 weight percent and about 95 weight percent flowable composite particles of a −80+325 Mesh particle size, and (c) between more than about zero weight percent and about 35 weight percent flowable composite particles of a −325 Mesh particle size. There should be an appreciation that the crushing operation will also generate fines, which are very small hard particles in the range of −400 Mesh and as small as −625 Mesh particles. The small hard particles can comprise any of the hard particle constituents of the flowable composite particles, but typically in a fractured condition; namely, fractured cast tungsten carbide (WC) particles, fractured cemented (cobalt) tungsten carbide (WC—Co) particles, and fractured macrocrystalline tungsten carbide particles. As mentioned above, while the particle size distribution of the flowable composite particles can vary, one preferred particle size distribution is: (a) between more than about zero weight percent and about 5 weight percent flowable composite particles of a +80 Mesh particle size, (b) between about 60 weight percent and about 95 weight percent flowable composite particles of a −80+325 Mesh particle size, and (c) between more than about zero weight percent and about 35 weight percent flowable composite particles of a −325 Mesh particle size.

As will become apparent from the test results set forth hereinafter, there is an advantage associated with using the flowable composite particles to form an infiltrated article. This advantage manifests itself in an optimum balance between erosion resistance and transverse rupture strength. In other words, the proper balance of a lower erosion number (which means better resistance to erosion) in combination with a higher transverse strength (which means a greater strength) results in a performance advantage. This advantage appears to be due to the nature of the flowable composite particles that is infiltrated to make an infiltrated article. The improvements in erosion resistance and transverse rupture strength are in comparison to an infiltrated matrix bit body material (infiltrated article) using virgin matrix material.

The virgin matrix material typically comprises a blend of tungsten carbide (WC) particles, cast tungsten carbide ($WC/W_2C$) particles, and metallic particles. This blend is a mechanical blend and there is no bonding between the metallic component and the tungsten carbide components. The particle size of this particle blend is −80+325 Mesh. This blend of −80+325 Mesh tungsten carbide (WC) particles, cast tungsten carbide ($WC/W_2C$) particles, and metallic particles is then infiltrated with an infiltrant alloy as previously disclosed herein to form an infiltrated matrix bit body material. Cast tungsten carbide consists of an approximately eutectoid composition of tungsten and carbon having a rapidly solidified thermodynamically nonequilibrium microstructure consisting of an intimate mixture of tungsten carbide (WC) and ditungsten carbide ($W_2C$). The carbon content of cast tungsten carbide is typically in the range of between about 3.7 to 4.2 weight percent. Cast tungsten carbide powder is available in two forms, crushed and spherical. Although either form may be used with the present invention, the crushed form is preferred because it costs significantly less and is much less brittle than the spherical form. The metal powder consists of at least one selected from the group consisting of the transition metals, main group metals, and combinations and alloys thereof. The metal powder is selected to aid in the infiltration of the matrix powder mixture by the infiltrant. Examples of preferred metal powders are nickel, iron, and 4600 grade steel. The 4600 grade steel has a nominal composition (in weight percent) of 1.57 percent nickel, 0.38 percent manganese, 0.32 percent silicon, 0.29 percent molybdenum, 0.06 percent carbon, and the balance iron.

The flowable composite particle comprises a collection of unfractured and fractured (e.g., crushed) irregularly-shaped hard particles such as, for example, macrocrystalline tungsten carbide (WC) particles and cast tungsten carbide particles ($WC/W_2C$) that are bonded to a binder alloy. One such exemplary binder alloy is a copper-based alloy such as a Cu—Ni—Mn alloy. The hard particles may also include cemented carbides (e.g., cemented (cobalt) tungsten carbide). The flowable composite particles are not a pure carbide powder. The flowable composite particles are of a finer particle size, i.e., a particle size distribution comprising: (a) between more than about zero weight percent and about 5 weight percent flowable composite particles of a +80 Mesh particle size, (b) between about 60 weight percent and about 95 weight percent flowable composite particles of a −80+325 Mesh particle size, and (c) between more than about zero weight percent and about 35 weight percent flowable composite particles of a −325 Mesh particle size. FIGS. 6-11 are photomicrographs that illustrate the microstructure of the flowable composite particles in powder or particulate form.

Figure 6:
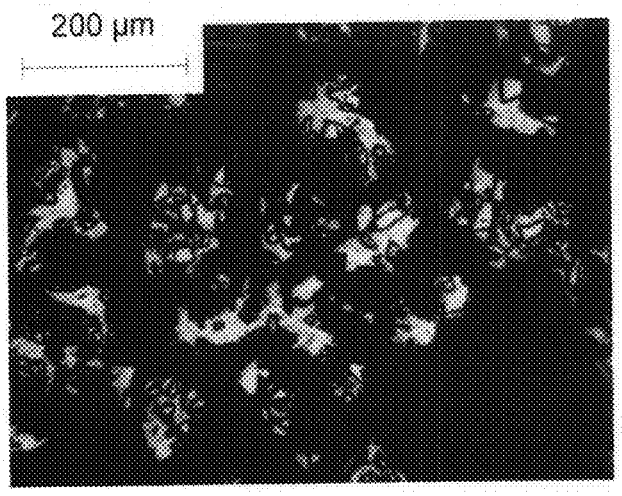
FIG. 6 is a photomicrograph (scale of 200 μm) of flowable composite particles shown as-polished at 100× magnification.
Figure 7:
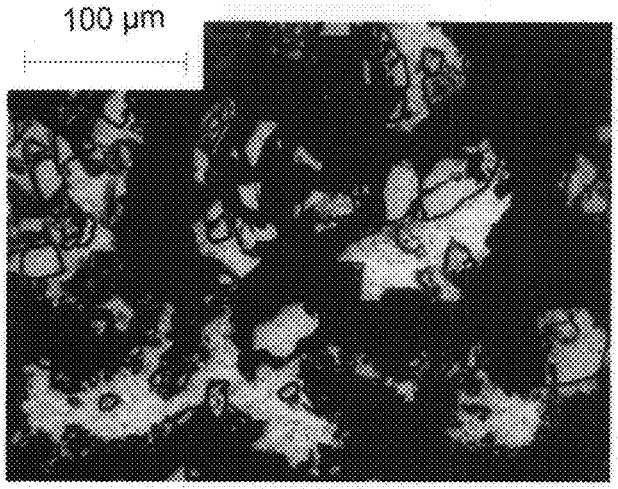
FIG. 7 is a photomicrograph (scale of 100 μm) of flowable composite particles shown as-polished at 200× magnification.
Figure 8:
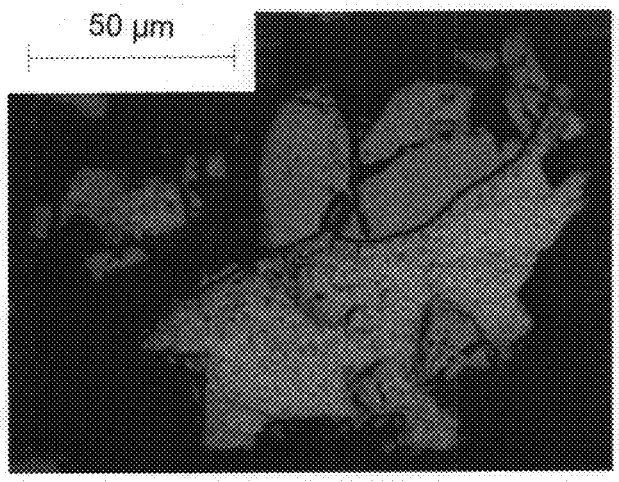
FIG. 8 is a photomicrograph (scale of 50 μm) of flowable composite particles shown as-polished at 500× magnification.
Figure 9:
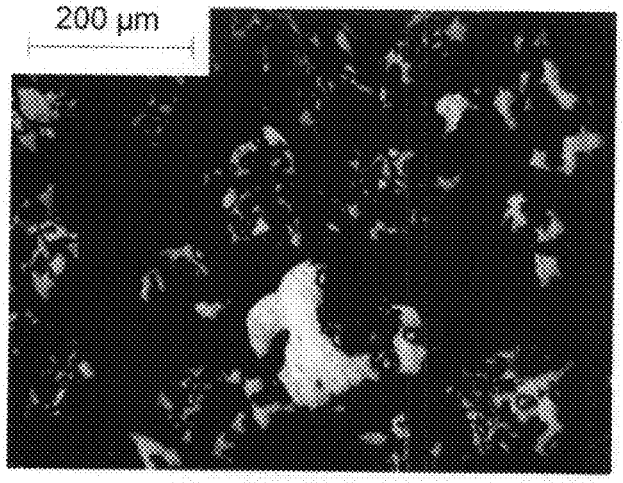
FIG. 9 is a photomicrograph (scale of 200 μm) of flowable composite particles shown etched for 10 seconds with Murakami etchant at 100× magnification.
Figure 10:
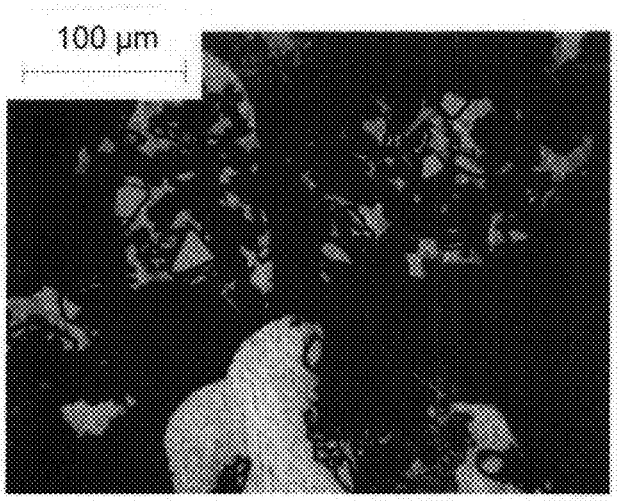
FIG. 10 is a photomicrograph (scale of 100 μm) of flowable composite particles shown etched for 10 seconds with Murakami etchant at 200× magnification.

More specifically, FIG. 6 is a photomicrograph (scale of 200 μm) of flowable composite particles shown as-polished at 100× magnification. FIG. 7 is a photomicrograph (scale of 100 μm) of flowable composite particles shown as-polished at 200× magnification. FIG. 8 is a photomicrograph (scale of 50 μm) of flowable composite particles shown as-polished at 500× magnification. FIG. 9 is a photomicrograph (scale of 200 μm) of flowable composite particles shown etched for 10 seconds with Murakami etchant at 100× magnification. FIG. 10 is a photomicrograph (scale of 100 μm) of flowable composite particles shown etched for 10 seconds with Murakami etchant at 200× magnification.

Figure 11:
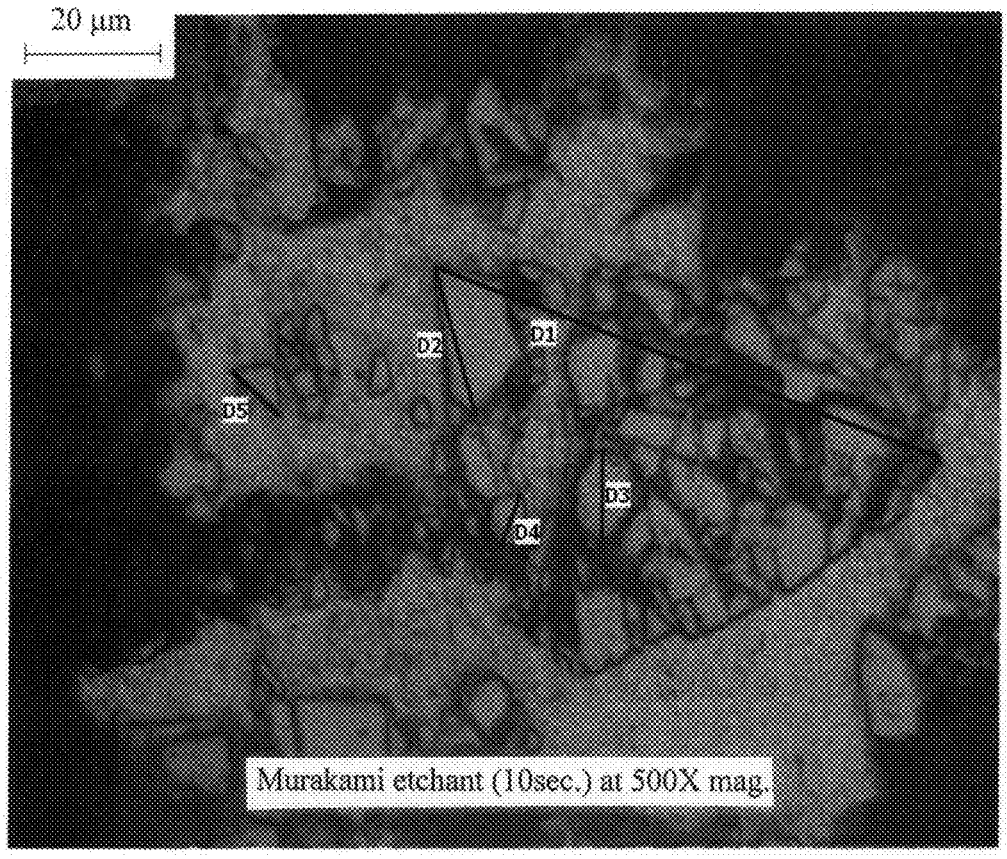
FIG. 11 is a photomicrograph (scale of 20 μm) of flowable composite particles shown etched for 10 seconds with Murakami etchant at 500× magnification and measurements of the hard particle sizes noted with dimensional markers for selected hard particles.
Figure 12:
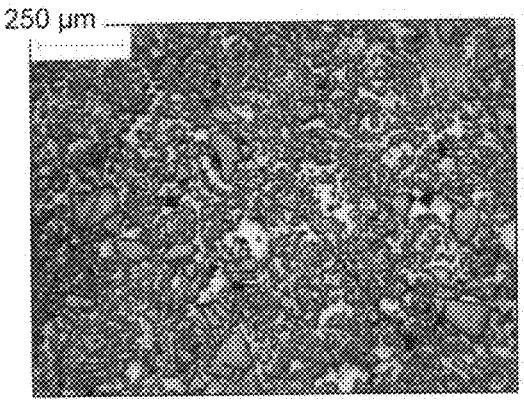
FIG. 12 is a photomicrograph of a bit body material comprising flowable composite particles infiltrated with infiltrant binder alloy to form the bit body material wherein the scale is 250 μm.

FIG. 11 is a photomicrograph (scale of 20 μm) of flowable composite particles, which are flowable composite particle shown etched for 10 seconds with Murakami etchant at 500× magnification. Dimensional markers show five dimensions in micrometers (μm). These dimensions are as follows: D1=19.70824 μm; D2=78.69430 μm; D3=11.41406 μm; D4=7.065282 μm; and D5=9.399940 μm.

Figure 13:
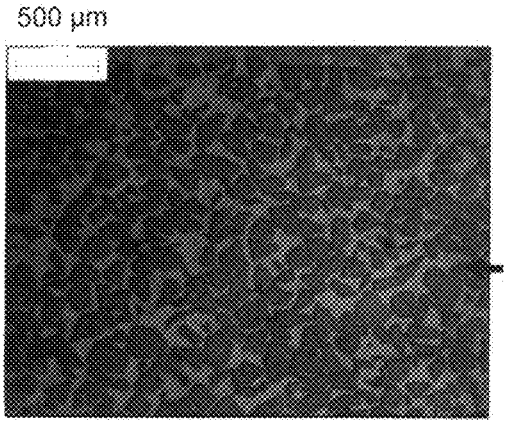
Prior Art FIG. 13
FIG. 13 is a photomicrograph of a prior art bit body material wherein the scale is 500 μm.
Figure 14:
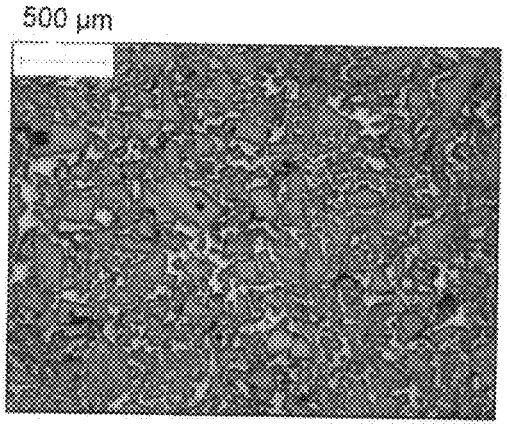
Prior Art FIG. 14
FIG. 14 is a photomicrograph of a prior art bit body material wherein the scale is 500 μm.
Figure 15:
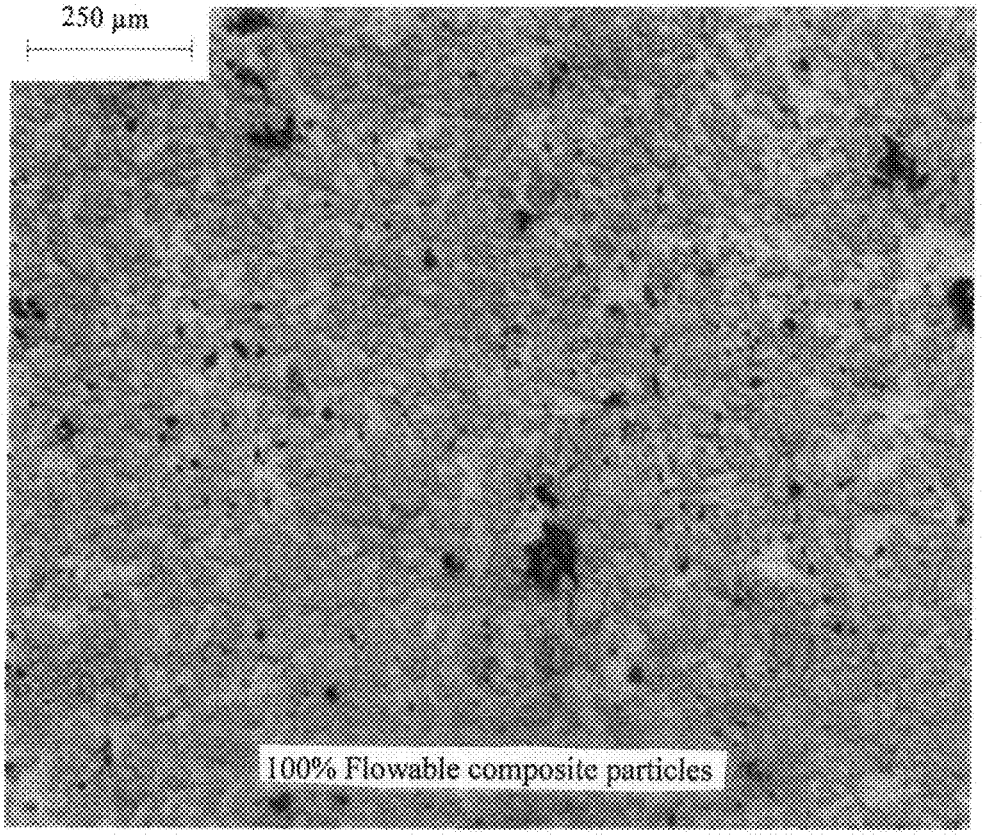
FIG. 15 is a photomicrograph of bit body material comprising 100 weight percent (wt. %) flowable composite particles infiltrated with infiltrant binder alloy to form the bit body material wherein the scale is 250 μm.

Even though the flowable composite particles have a particle size distribution is: (a) between more than about zero weight percent and about 5 weight percent flowable composite particles of a +80 Mesh particle size, (b) between about 60 weight percent and about 95 weight percent flowable composite particles of a −80+325 Mesh particle size, and (c) between more than about zero weight percent and about 35 weight percent flowable composite particles of a −325 Mesh particle size, when placed in the mold, the flowable composite particles flow well into the volume of the mold so as to fill the volume of the mold despite the finer particle size. When melted, the infiltrant alloy flows thoroughly throughout the particulate mass of the flowable composite particles in the mold despite the hard particle size. When the molten infiltrant alloy infiltrates the particulate mass, the binder alloy surrounding the flowable composite particles melts so that the infiltrant alloy and the binder alloy melt together. As mentioned above, applicants believe that favorable and improved properties and especially the combination of erosion resistance and transverse rupture strength are due to the fact that the flowable composite particles exhibit excellent flowability so as to fill the volume of a mold prior to infiltration. Further, applicants believe that favorable and improved properties and especially the combination of erosion resistance and transverse rupture strength are achieved because a binder alloy is positioned in the volume of the mold prior to the melting and infiltration process. The result is an infiltrated matrix bit body material that has a substantially uniform microstructure of a finer particle size such as shown in FIG. 15. In comparison, the microstructures of exemplary infiltrated articles using virgin matrix material are illustrated in FIG. 13 and FIG. 14.

Figure 23:
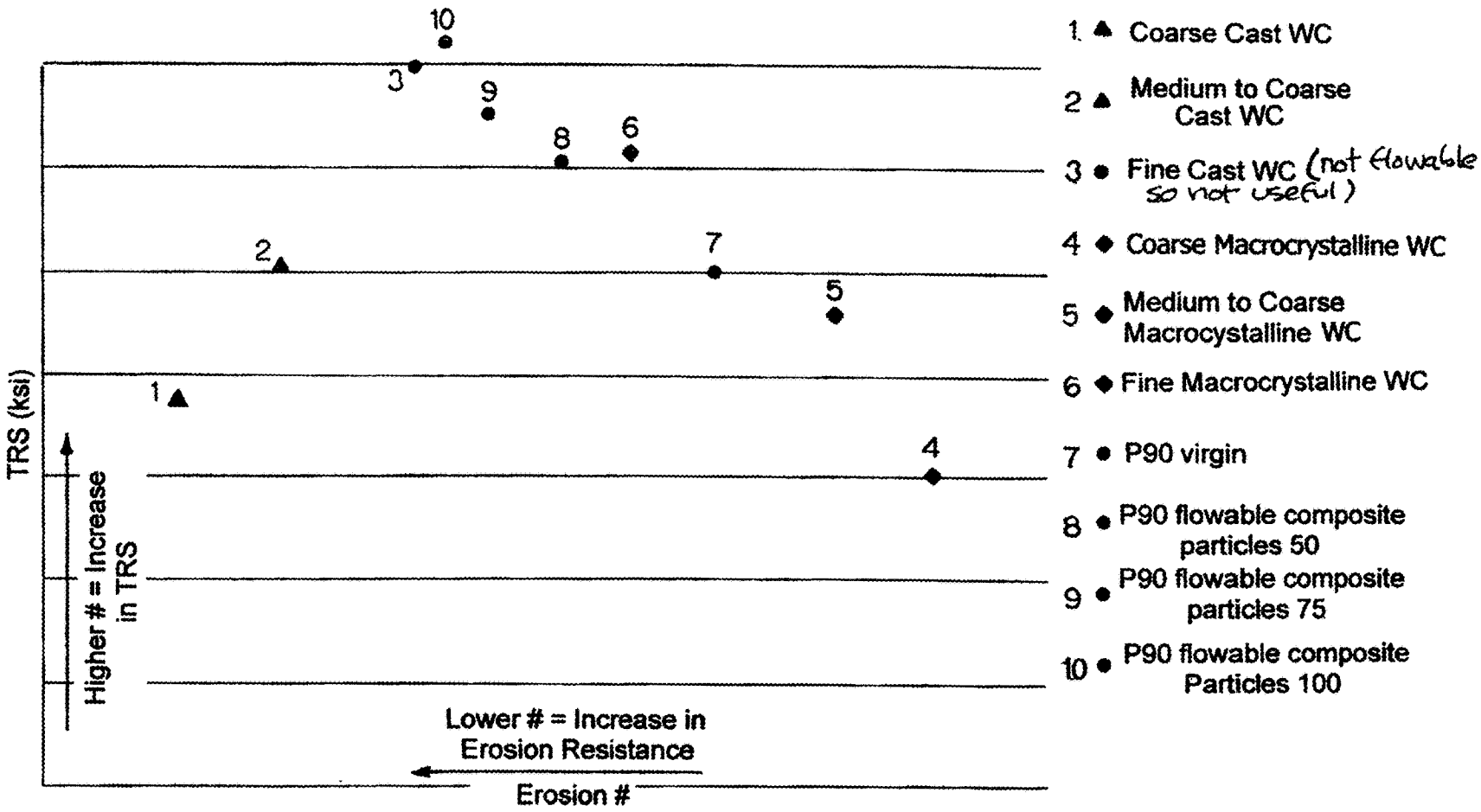
FIG. 23 is a plot that shows the transverse rupture strength (ksi) verses the erosion resistance data (erosion number) for a number of comparative compositions and a number of inventive compositions of the bit body material.

Rather than using 100% of the flowable composite particles, one can mix the flowable composite particles with virgin matrix material (e.g., a blend of tungsten carbide (WC) particles, cast tungsten carbide ($W_2C$) particles, and metallic particles) to form a particulate mass that contains a partial content of the flowable composite particles that can be infiltrated with an infiltrant alloy to form an infiltrated article (e.g., infiltrated matrix bit body material). FIGS. 15 through 18 are photomicrographs that show in a comparative fashion the microstructure of different compositions of particulate material that contains the flowable composite particles, which is then infiltrated with an infiltrant alloy. These photomicrographs show the effect of using flowable composite particles, especially considered in light of the physical properties such as shown in FIG. 23.

Figure 15A:
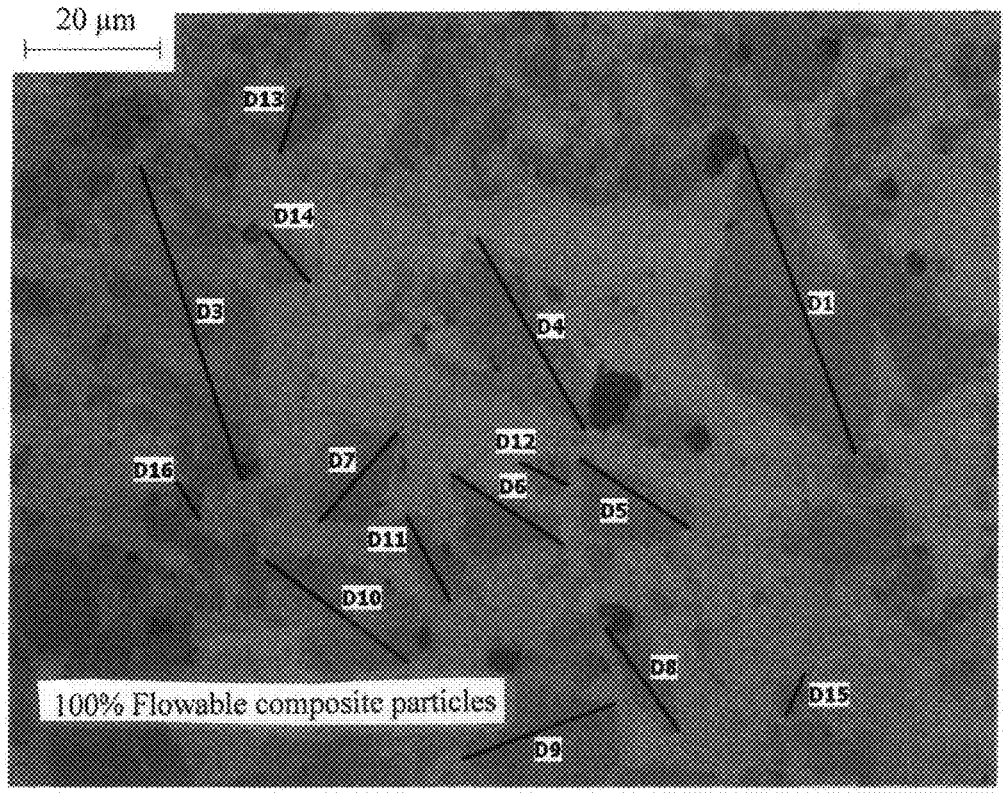
FIG. 15A is a photomicrograph of bit body material comprising 100 weight percent (wt. %) flowable composite particles infiltrated with infiltrant binder alloy to form the bit body material wherein the scale is 20 μm, and measurements of the hard particle sizes noted with dimensional markers for selected hard particles.

FIG. 15 shows the microstructure of an infiltrated article (e.g., infiltrated matrix bit body material) that used 100 weight % of the flowable composite particles. FIG. 15 shows a finer microstructure that is generally uniform. The example that corresponds to using 100% flowable composite particles is Example 10 in FIG. 24. Example 10 has a low erosion number, which equates to an increase in erosion resistance. Example 10 has a higher transverse rupture strength, which equates to greater strength. Therefore, it is apparent that the infiltrated matrix bit body material using the 100% the flowable composite particles has a finer and more uniform microstructure, as well as a very favorable erosion resistance and transverse rupture strength. FIG. 15A shows the microstructure of an infiltrated article (e.g., infiltrated matrix bit body material) that used 100 weight % of the flowable composite particles. FIG. 15A displays dimensional markers that reflect the dimensions are set forth in the below Table—Dimensions for FIG. 15A

TABLE

Dimensions for FIG. 15A

| Dimension | Micrometers (μm) |
|---|---|
| D1 | 44.79449 |
| D3 | 44.95868 |
| D4 | 29.13646 |
| D5 | 17.36122 |
| D6 | 16.86441 |
| D7 | 16.60738 |
| D8 | 16.76026 |
| D9 | 23.38729 |
| D10 | 25.41497 |
| D11 | 13.10566 |
| D12 | 7.394269 |
| D13 | 8.765891 |
| D14 | 8.252033 |
| D15 | 5.793289 |
| D16 | 5.094212 |

Figure 16:
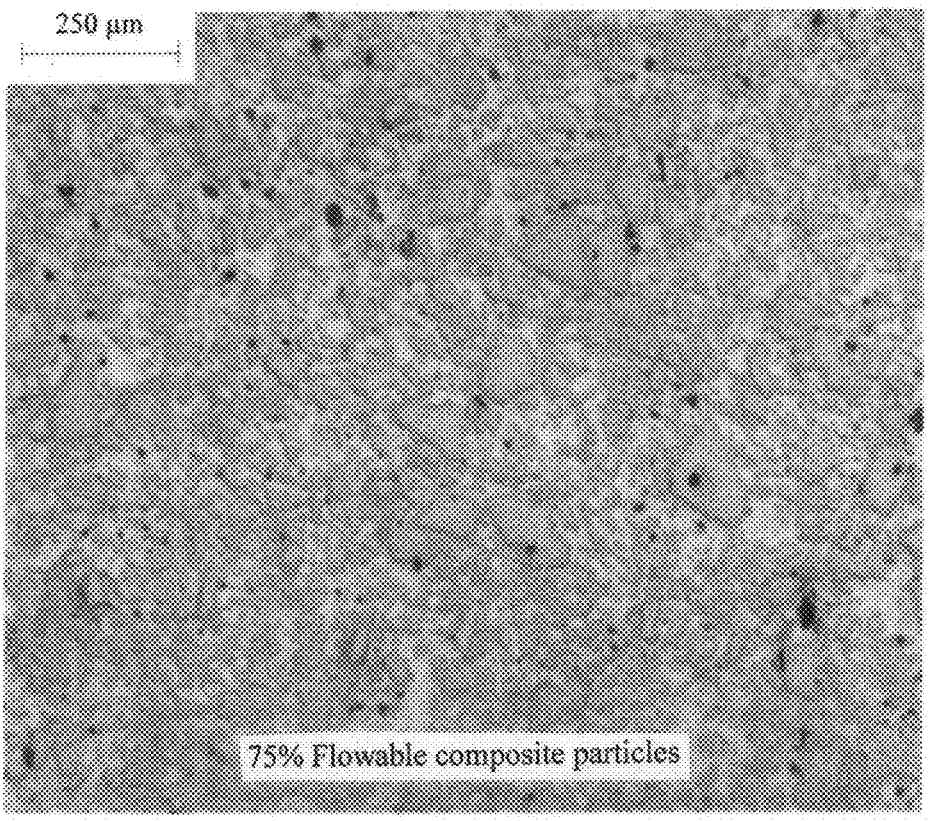
FIG. 16 is a photomicrograph of bit body material comprising 75 weight percent (wt. %) flowable composite particles and the balance virgin material infiltrated with infiltrant binder alloy to form the bit body material wherein the scale is 250 μm.
Figure 24:
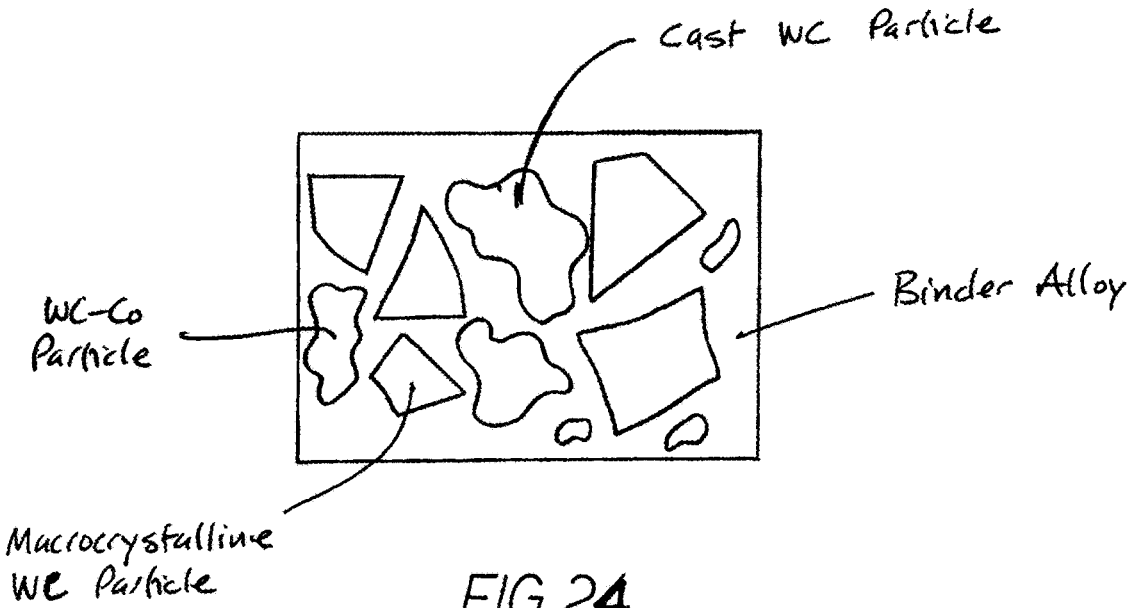
FIG. 24 is a schematic view of a coupon of material prior to the comminution or pulverization operation that renders the coupon into the flowable composite particles.

FIG. 16 shows the microstructure of an infiltrated article (an infiltrated matrix bit body material) that used 75 weight % the flowable composite particles, which are the flowable composite particle, and 25 weight % virgin material. FIG. 16 shows a microstructure that is somewhat coarser than the microstructure of FIG. 15. In FIG. 24, the example that corresponds to using 75 weight percent the flowable composite particles and 25 weight % virgin material is Example 9. Example 9 shows a favorable erosion resistance and transverse rupture strength. Although Example 9 has favorable properties, Example 9 does not show as favorable properties as Example 10.

Figure 17:
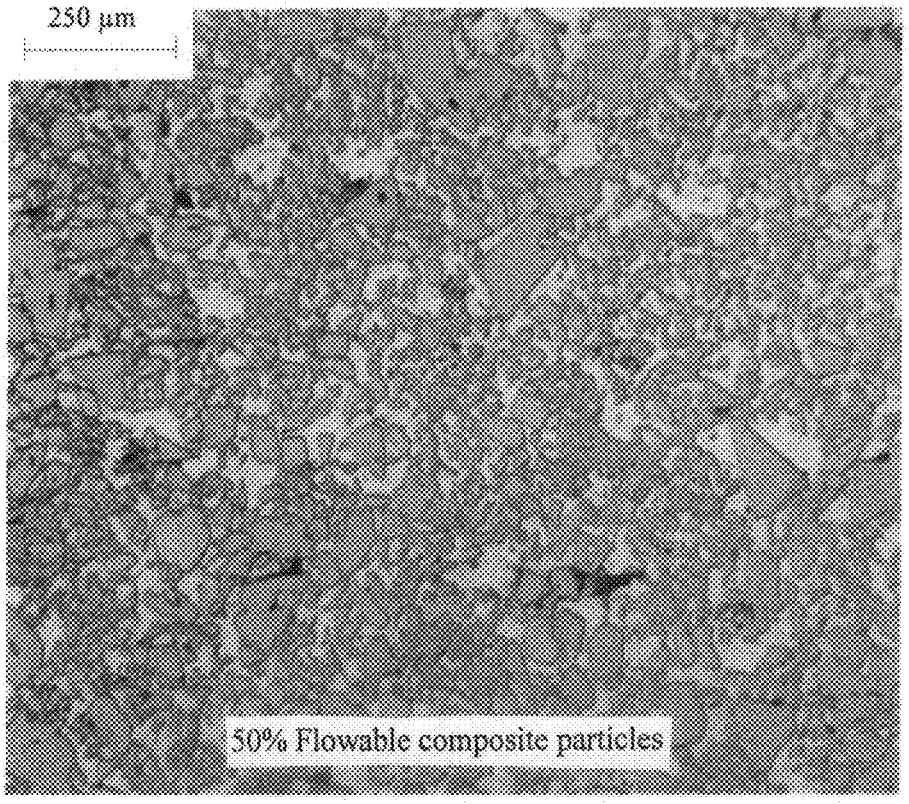
FIG. 17 is a photomicrograph of bit body material comprising 50 weight percent (wt. %) flowable composite particles and the balance virgin material infiltrated with infiltrant binder alloy to form the bit body material wherein the scale is 250 μm.

FIG. 17 shows the microstructure of an infiltrated article (an infiltrated matrix bit body material) that used 50 weight % the flowable composite particles, which are the flowable composite particles and 50 weight % virgin material. FIG. 17 shows a microstructure that is somewhat coarser than the microstructure of FIG. 16 and is more coarse than the microstructure of FIG. 15. In FIG. 23, the example that corresponds to using 50 weight percent of the flowable composite particles and 50 weight % virgin material, which are the flowable composite particle material is Example 8. FIG. 23 shows that Example 8 has favorable erosion resistance and transverse rupture strength, but these properties are not as favorable as those of Examples 9 and 10.

Figure 18:
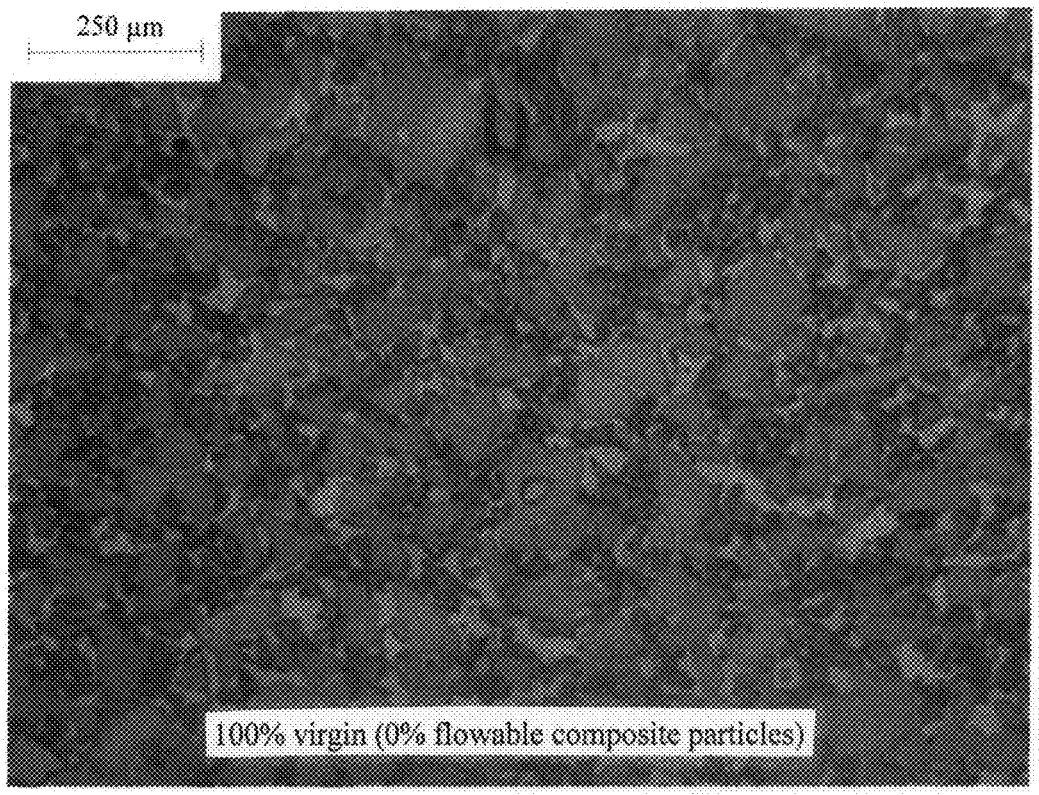
FIG. 18 is a photomicrograph of bit body material comprising 100 weight percent (wt. %) virgin material (zero weight percent flowable composite particles) infiltrated to form the bit body material wherein the scale is 250 μm.

FIG. 18 shows the microstructure of an infiltrated matrix bit body material that used 100 weight % virgin material. As is apparent, there are differences between the microstructures that are due to the composition of flowable composite particles. FIG. 18 shows a microstructure that is coarser than the microstructure of Examples 8 or 9 or 10. The erosion resistance and transverse rupture strength for Example 7 is less favorable than for any one of Examples 8 or 9 or 10, which use different amounts of the flowable composite particles.

Figure 19:
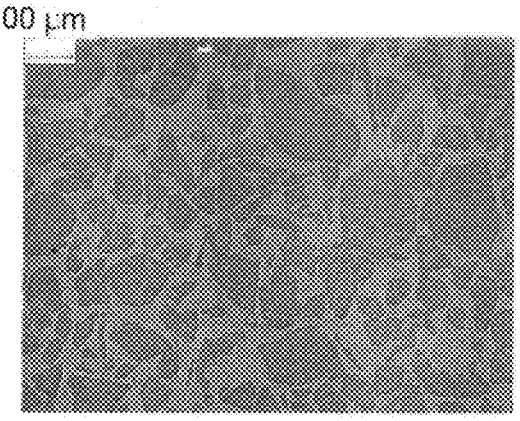
PRIOR ART FIG. 19
FIG. 19 is a photomicrograph of PRIOR ART bit body material comprising −80/+325 Mesh coarse cast tungsten carbide infiltrated to form the bit body material wherein the scale is 100 μm.

FIGS. 19 through 23 show the microstructures of different infiltrated matrix bit body material that used different particulate materials infiltrated by an infiltrant alloy. FIG. 19 shows the microstructure of an infiltrated matrix bit body material that used coarse cast tungsten carbide particles (−80+325 Mesh particle size) for the particulate matrix material. This material corresponds to Example 1 in FIG. 23. As shown in FIG. 23, Example 1 has favorable erosion resistance, but not as favorable transverse rupture strength. The combination of the erosion resistance and the transverse rupture strength is not as favorable as Examples 8 or 9 or 10.

Figure 20:
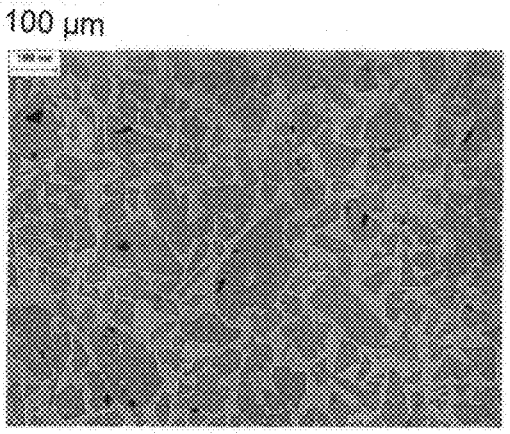
PRIOR ART FIG. 20
FIG. 20 is a photomicrograph of PRIOR ART bit body material comprising −80/+325 Mesh coarse macrocrystalline tungsten carbide infiltrated to form the bit body material wherein the scale is 100 μm.

FIG. 20 shows the microstructure of infiltrated matrix bit body material that used coarse macrocrystalline tungsten carbide particles (−80+325 Mesh particle size) for the particulate matrix material. Macrocrystalline tungsten carbide is essentially stoichiometric tungsten carbide (WC) which is, for the most part, in the form of single crystals. Some large crystals of macrocrystalline tungsten carbide are bicrystals. U.S. Pat. No. 3,379,503 to McKenna and U.S. Pat. No. 4,834,963 to Terry et al., both of which are assigned to the assignee of the present patent application, disclose methods of making macrocrystalline tungsten carbide. This material corresponds to Example 4 in FIG. 23. As shown in FIG. 23, this material does not have favorable properties in comparison to any one of Examples 8 or 9 or 10.

Figure 21:
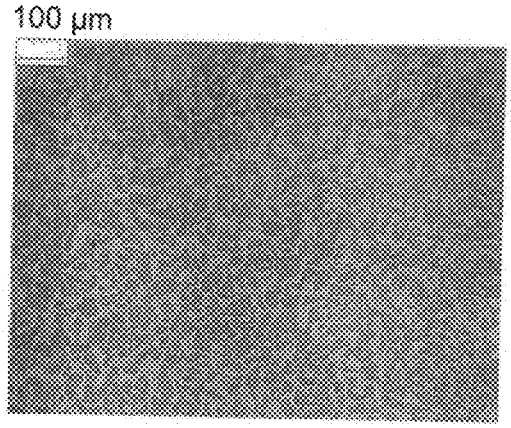
FIG. 21 is a photomicrograph of bit body material comprising −325 Mesh fine cast tungsten carbide infiltrated to form the bit body material wherein the scale is 100 μm.

FIG. 21 shows the microstructure of infiltrated matrix bit body material that used fine cast tungsten carbide particles (−325 Mesh particle size) for the particulate matrix material. This material corresponds to Example 3 in FIG. 23. Example 3 exhibits properties that are the closest to those of Example 10. However, Sample 3 and the −325 Mesh particle size cast tungsten carbide particles that comprise a part of the microstructure of FIG. 21 do not exhibit satisfactory flow properties. In this regard, the Hall flow data below, which is based on ASTM Standard B213-13, shows a lack of flow for −325 Mesh particles. While the flow rate for the sample comprising 100 weight percent flowable composite particles and the flow rate for the sample comprising 75 weight percent and 25 weight percent virgin material are not as high as the flow rate for the 100 weight percent virgin P90 material, the flow rates of 22 grams/50 seconds and 18 grams/50 seconds are sufficient to fill the volumes of molds for complex geometries.

TABLE 2

| Sample | Flow Rate (seconds/50 grams) |
|---|---|
| 100 weight percent flowable composite particles (The particle size distribution is: (a) between more than about zero weight percent and about 5 weight percent flowable composite particles of a +80 Mesh particle size, (b) between about 60 weight percent and about 95 weight percent flowable composite particles of a −80 +325 Mesh particle size, and (c) between more than about zero weight percent and about 35 weight percent flowable composite particles of a −325 Mesh particle size). | 22 seconds/50 grams |
| 75 weight percent flowable composite particles (The particle size distribution is: (a) between more than about zero weight percent and about 5 weight percent flowable composite particles of a +80 Mesh particle size, (b) between about 60 weight percent and about 95 weight percent flowable composite particles of a −80 +325 Mesh particle size, and (c) between more than about zero weight percent and about 35 weight percent flowable composite particles of a −325 Mesh particle size) and balance virgin material | 18 seconds/50 grams |
| Virgin P90 material (−80 Mesh) | 9.6 seconds/50 grams |
| −325 Mesh cast tungsten carbide particles | NO FLOW |
| −325 Mesh macrocrystalline tungsten carbide particles | NO FLOW |

Figure 22:
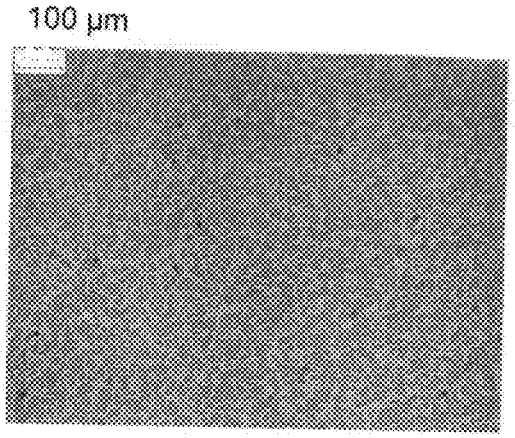
FIG. 22 is a photomicrograph of bit body material comprising −325 Mesh fine macrocrystalline WC infiltrated to form the bit body material wherein the scale is 100 μm.

FIG. 22 shows the microstructure of an infiltrated matrix bit body material that used fine macrocrystalline tungsten carbide particles (−325 Mesh particle size) for the particulate matrix material. This material corresponds to Example 6 in FIG. 24. Example 6 has favorable transverse rupture strength, but does not have as favorable erosion resistance so that the combination of properties of Example 6 is less favorable than any one of Examples 8 or 9 or 10. There should be an appreciation that the flowable composite particles of Examples 8, 9 and 10 exhibit satisfactory flowability properties. Improved properties of the infiltrated article are a result of the better flowability of the flowable composite particles and fine particle size of fractured hard particles and unfractured hard particles.

FIG. 23 is a plot showing the erosion number, which is a measure of erosion resistance wherein the lower number equates to greater resistance to erosion, and transverse rupture strength (ksi) wherein the higher number equates to greater strength.

Referring to the examples shown in FIG. 23, for each example, a matrix powder mixture was formed from the designated particulates. For each example, the matrix powder mixture was placed into a graphite mold as a particulate mass and the particulate mass being subsequently infiltrated with MACROFIL 53 infiltrant alloy create an infiltrated metal matrix. FIG. 23 shows the test results for Examples 1-10 which reflect the erosion resistance and transverse rupture strength. The key on the right-hand side of the plot correlates the example with the composition of the matrix particulate material. Examples 8-10 use to some degree the flowable composite particles. Examples 1-7 do not use any flowable composite particles. Example 3 is not flowable, and hence, would be unsuitable to use to produce an infiltrated article. Appropriate size specimens of each of these infiltrated metal matrices materials were used for measuring the transverse rupture strength and erosion resistance. The transverse rupture strength was measured by a three-point bending test per ASTM B406-96(2010) entitled Standard Test for Transverse Rupture Strength of Cemented Carbides and using infiltrated matrix pins. Higher values indicate higher strength.

The erosion resistance was measured by a modified ASTM Standard G76 test. The modification includes using a wet slurry comprised of 50/70 silica sand and water which is forced out of a jet nozzle at a pressure of 1000 psi. The high pressure slurry impinges the sample surface for 1 minute between 20-90 degrees, more specifically at 45 degree angle relative to the impinging slurry stream. The amount of sand used during test is measured and then weight loss of the sample is divided by the sand usage to give the erosion number. A lower erosion factor value indicates better resistance to erosion.

FIG. 24 is schematic drawing of a coupon of material that comprises a binder alloy with a plurality of hard particles bonded to the binder alloy. The hard particles are labeled "cast WC particle" and "macrocrystalline WC particle" and WC—Co particle, but there is no intention to restrict the kinds of hard particles that can be in the article. Typically, these hard particle comprise macrocrystalline tungsten carbide (WC) grains, cast tungsten carbide ($WC/W_2C$) grains, and cemented (cobalt) tungsten carbide (WC—Co) grains. This article can be, for example and without limitation, a spent infiltrated matrix bit body of a drill bit (e.g., a subterranean drill bit). This article can also be unused infiltrated articles such as coupons with specific components. As shown in FIG. 24, this article has not been subjected to a comminution or pulverization operation (e.g., a progressive stepped comminution or pulverization operation).

Figure 25:
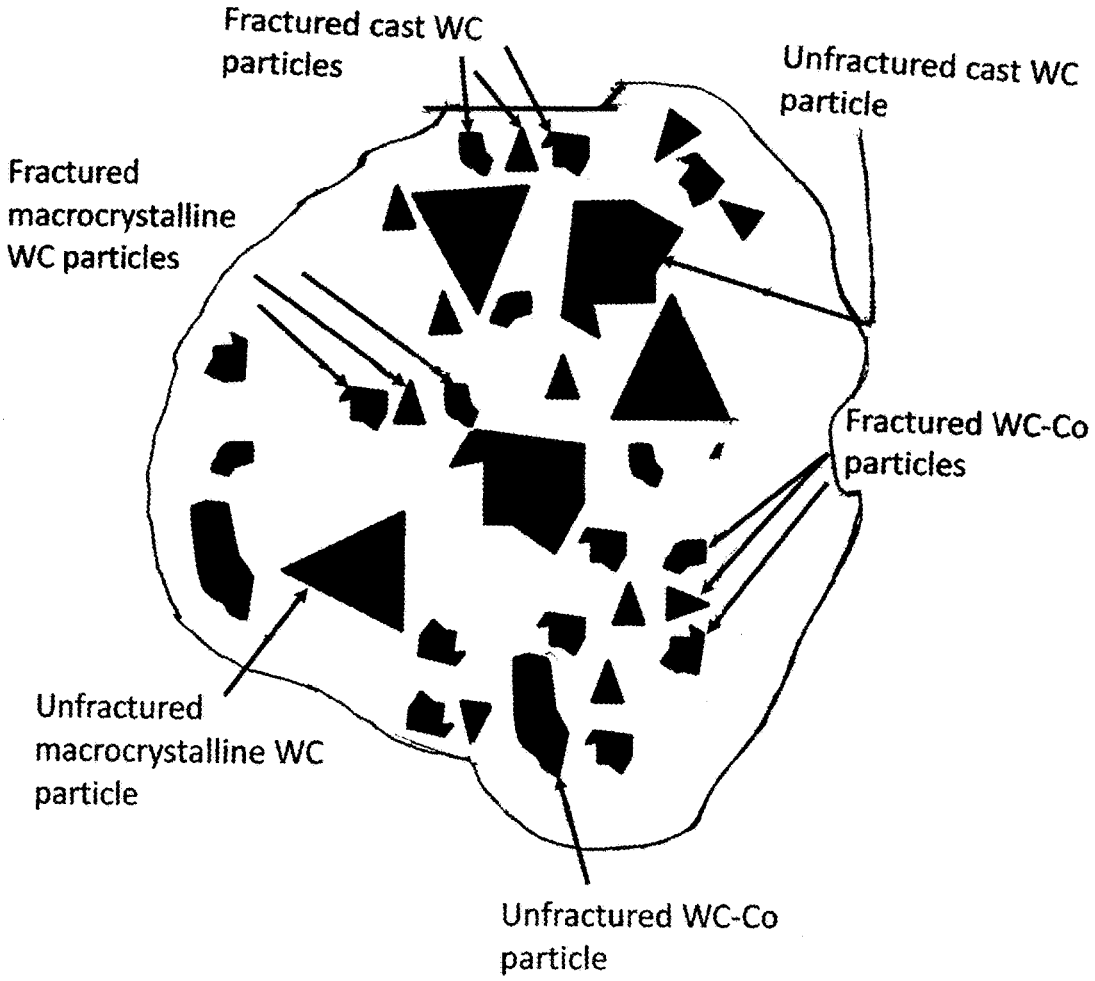
FIG. 25 is a schematic view that shows the constituents of a flowable composite particle.

FIG. 25 is a schematic drawing of flowable composite particles wherein the components thereof are labeled. The plurality of flowable composite particles is the result of subjecting the article of FIG. 24 to a comminution or pulverization operation (e.g., a progressive stepped comminution or pulverization operation). The flowable composite particle that is labeled comprises a binder alloy that bonds with the following hard particles: a fractured cast WC particle, an unfractured cast WC particle, a fractured macrocrystalline WC particle and an unfractured macrocrystalline WC particle and a fractured cemented (cobalt) tungsten carbide (WC—Co) particle and an unfractured cemented (cobalt) tungsten carbide (WC—Co) particle. There should be an appreciation that the hard particles are not limited to the specific particles set forth above.

Figure 26:
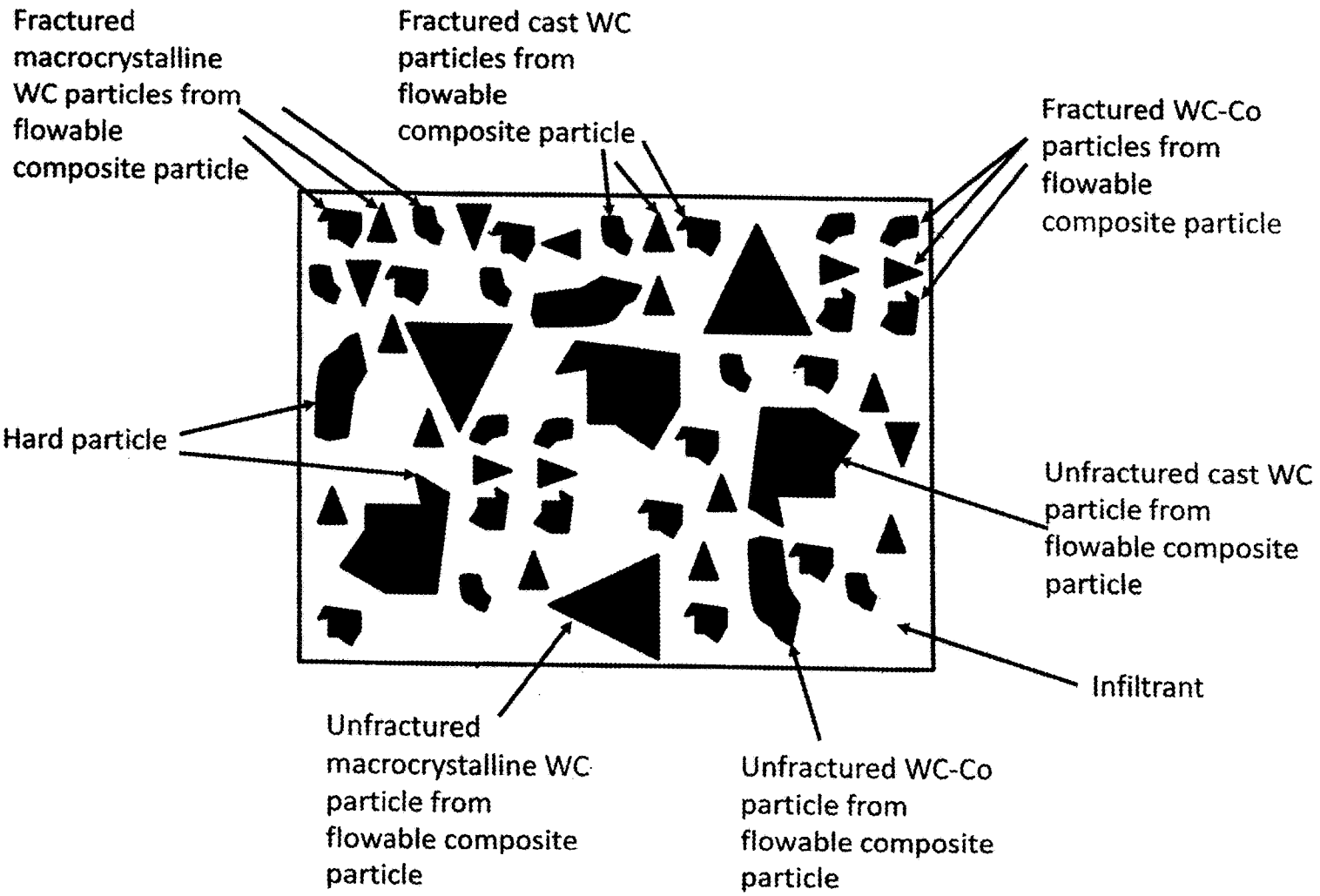
FIG. 26 is a schematic view of an infiltrated article that comprises a plurality of unbound hard particles and a plurality of flowable composite particles infiltrated with a molten infiltrant alloy wherein upon infiltration with the molten infiltrant alloy, the binder alloy of the flowable composite particles melts to form the infiltrated article.

FIG. 26 is a schematic view showing an infiltrated article comprising a plurality of flowable composite particles, i.e., a particulate mass of the flowable composite particles, in an infiltrant alloy, as well as hard particles. Each of the flowable composite particles is like those shown in FIG. 25. The infiltrated article can be a bit body as well as a wear part, which is an article subject to wear through a mechanism such as, for example and without limitation, abrasion.

Should there be a discrepancy between the disclosure of a photomicrograph and the written description thereof, the disclosure of the photomicrograph should control.

It is apparent that the present invention provides an infiltrated article (an infiltrated matrix bit body material) that exhibits a combination of favorable erosion resistance and favorable transverse rupture strength. By using flowable composite particles or at least using flowable composite particles as a portion of the particulate mass, the infiltrated article exhibits favorable and improved properties and especially the combination of erosion resistance and transverse rupture strength. Applicants believe that favorable and improved properties and especially the combination of erosion resistance and transverse rupture strength are due to the fact that the flowable composite particles exhibit excellent flowability so as to fill the volume of a mold prior to infiltration. Further, applicants believe that favorable and improved properties and especially the combination of erosion resistance and transverse rupture strength are achieved because a binder alloy is positioned in the volume of the mold prior to the melting and infiltration process. This is because the flowable composite particles in the mold comprise the hard particles bonded to the binder alloy so that the binder alloy is in position in the mold prior to the melting and infiltration of the infiltrant alloy into the particulate mass. Still further, applicants believes that favorable and improved properties, especially the combination of erosion resistance and transverse rupture strength, are due to the use of the smaller hard particles. These smaller hard particles can be of the size of −400 Mesh and −625 Mesh.

While some embodiments of the present invention have been shown and described, it will be obvious to those skilled in the art that many changes and modifications may be made thereto without departing from the spirit and scope of the present invention as described in the following claims. All patent applications, patents, and all other publications referenced herein are incorporated herein in their entireties to the full extent permitted by law.

What is claimed is:

1. An infiltrated article comprising:

a particulate mass comprising flowable composite particles prior to infiltration with an infiltrant alloy, wherein each of the flowable composite particles comprising a plurality of bound hard particles and a binder alloy, and the bound hard particles comprising unfractured bound hard particles and fractured bound hard particles, each of the bound hard particles is bonded to the binder alloy, and the bound hard particles having a particle size of −325 Mesh, and the flowable composite particle having a particle size distribution comprising: (a) between more than about zero weight percent and about 5 weight percent flowable composite particles of a +80 Mesh particle size, (b) between about 60 weight percent and about 95 weight percent flowable composite particles of a −80+325 Mesh particle size, and (c) between more than about zero weight percent and about 35 weight percent flowable composite particles of a −325 Mesh particle size;

the particulate mass further comprising a plurality of fractured unbound hard particles having a particle size of −400 Mesh wherein a portion of the fractured unbound hard particles having a particle size of −625 Mesh; and each of the fractured unbound hard particles and the flowable composite particles is surrounded by the infiltrant alloy wherein the binder alloy being melted by the infiltrant alloy.

2. The infiltrated article according to claim 1 wherein the bound hard particles comprise macrocrystalline tungsten carbide particles, cast tungsten carbide particles, and cemented tungsten carbide particles, and the unbound fractured hard particles comprise macrocrystalline tungsten carbide particles, cast tungsten carbide particles, and cemented tungsten carbide particles.

3. The infiltrated article according to claim 1 wherein the infiltrant alloy comprises between about 45 weight percent and about 60 weight percent copper, between about 20 weight percent and about 30 weight percent manganese and between about 10 weight percent and about 20 weight percent nickel and between about 4 weight percent and about 12 weight percent zinc.

4. The infiltrated article according to claim 1 wherein the infiltrant alloy comprising between about 45 weight percent and about 55 weight percent copper and between about 20 weight percent and about 30 weight percent manganese and between about 20 weight percent and about 30 weight percent nickel.

5. The infiltrated article according to claim 1 wherein the fractured bound hard particles having a particle size of −400 Mesh.

6. The infiltrated article according to claim 5 wherein a portion of the fractured bound hard particles having a particle size of −625 Mesh.

7. The infiltrated article according to claim 1 wherein the flowable composite particles comprising between about 50 weight percent and about 75 weight percent of the particulate mass, and virgin matrix particulates comprising between about 25 weight percent and about 50 weight percent of the particulate mass, and wherein the virgin matrix particulates comprising a blend of tungsten carbide particles, and cast tungsten carbide particles and metallic particles.

8. The infiltrated article according to claim 1 wherein the flowable composite particles comprising about 50 weight percent of the particulate mass, and virgin matrix particulates comprising about 50 weight percent of the particulate mass, and wherein the virgin matrix particulates comprising a blend of tungsten carbide particles, and cast tungsten carbide particles and metallic particles.

9. The infiltrated article according to claim 1 wherein the flowable composite particles comprising between about 75 weight percent of the particulate mass, and virgin matrix particulates comprising about 25 weight percent of the particulate mass, and wherein the virgin matrix particulates comprising a blend of tungsten carbide particles, and cast tungsten carbide particles and metallic particles.

10. The infiltrated article according to claim 1 wherein the binder alloy is different from the infiltrant alloy.

11. The infiltrated article according to claim 1 wherein the infiltrant alloy melts the binder alloy.

12. The infiltrated article according to claim 1 wherein the infiltrated article is a bit body.

13. The infiltrated article according to claim 1 wherein the infiltrated article is a wear part.

* * * * *